US011168482B2

(12) United States Patent
Hannig et al.

(10) Patent No.: US 11,168,482 B2
(45) Date of Patent: Nov. 9, 2021

(54) PANEL

(71) Applicant: SURFACE TECHNOLOGIES GMBH & CO. KG, Baruth (DE)

(72) Inventors: Hans-Jürgen Hannig, Bergisch Gladbach (DE); Erich Schäfers, Oberkail (DE)

(73) Assignee: SURFACE TECHNOLOGIES GMBH & CO. KG, Baruth (DE)

( * ) Notice: Subject to any disclaimer, the term of this patent is extended or adjusted under 35 U.S.C. 154(b) by 0 days.

(21) Appl. No.: 16/766,406

(22) PCT Filed: Nov. 23, 2018

(86) PCT No.: PCT/EP2018/082383
§ 371 (c)(1),
(2) Date: May 22, 2020

(87) PCT Pub. No.: WO2019/101928
PCT Pub. Date: May 31, 2019

(65) Prior Publication Data

US 2020/0378136 A1 Dec. 3, 2020

(30) Foreign Application Priority Data

Nov. 24, 2017 (EP) ..... 17203608

(51) Int. Cl.
*E04B 2/00* (2006.01)
*E04F 15/02* (2006.01)
*E04F 13/08* (2006.01)

(52) U.S. Cl.
CPC .... *E04F 15/02038* (2013.01); *E04F 13/0894* (2013.01); *E04F 2201/0107* (2013.01);
(Continued)

(58) Field of Classification Search
CPC ..... E04F 15/02033; E04F 15/02038; E04F 15/107; E04F 15/102; E04F 2201/042;
(Continued)

(56) References Cited

U.S. PATENT DOCUMENTS 4,426,820 A * 1/1984 Terbrack ..... E01C 13/107 52/590.1
7,617,651 B2 * 11/2009 Grafenauer ..... E04F 15/02 52/592.1

(Continued)

FOREIGN PATENT DOCUMENTS

CN 101910528 A 12/2010
DE 102009019492 A1 11/2010

(Continued)

OTHER PUBLICATIONS

Russian Search Report, dated Nov. 11, 2020, 2 Pages.
Chinese Office Action dated May 31, 2021, 9 Pages.

*Primary Examiner* — Chi Q Nguyen
(74) *Attorney, Agent, or Firm* — Lucas & Mercanti, LLP; Klaus P. Stoffel

(57) ABSTRACT

A panel, including a first edge pair of complementary interlocking retaining profiles on opposing panel edges. One of the retaining profiles has a locking groove having a retaining strip, which protrudes at the free end of the lower groove wall toward the panel surface. The complementary retaining profile has a locking tongue, which, in the joined state, interacts with the retaining surface of the retaining strip, and a play with both vertical and horizontal components so that the retaining profiles are movable perpendicularly to the panel surface and movable perpendicularly to the panel edges and parallel to the panel surface. In a joining step, the bottom side of the locking tongue is laid horizontal onto the retaining strip of the locking groove and then the tongue top side is slid against the inside of the upper groove
(Continued)

wall, the tongue top side touching the inside of the upper groove wall in the region of the panel core.

23 Claims, 21 Drawing Sheets

(52) U.S. Cl.
CPC ..... *E04F 2201/0138* (2013.01); *E04F 2201/0153* (2013.01); *E04F 2201/043* (2013.01)

(58) Field of Classification Search
CPC ..... E04F 2201/0107; E04F 2201/03; E04F 2201/0552; E04F 2201/023; E04F 2201/0535; E04F 2201/0146; E04F 2201/043; E04F 2201/0547; E04F 2201/0153; E04F 2201/0138
USPC .. 52/592.1, 592.3, 592.2, 578, 588.1, 309.1, 52/309.3
See application file for complete search history.

(56) References Cited

U.S. PATENT DOCUMENTS 8,720,150 B2 * 5/2014 Hannig ..... E04F 13/0894 52/590.2
8,833,028 B2 * 9/2014 Whispell ..... E04F 15/02005 52/588.1
9,695,851 B2 * 7/2017 Hannig ..... F16B 5/008
9,874,028 B2 * 1/2018 Boucke ..... E04F 15/02038
10,508,457 B2 12/2019 Hannig
10,711,466 B2 * 7/2020 Hannig ..... E04F 15/105
2004/0035077 A1 2/2004 Martensson
2004/0128934 A1 * 7/2004 Hecht ..... E04F 15/02 52/578
2007/0193178 A1 * 8/2007 Groeke ..... E04F 15/02 52/578
2009/0133353 A1 5/2009 Pervan
2010/0154343 A1 * 6/2010 Dammers ..... E04F 15/02 52/588.1
2010/0293879 A1 11/2010 Pervan
2011/0167744 A1 * 7/2011 Whispell ..... E04F 15/02 52/309.1
2012/0017534 A1 * 1/2012 Oh ..... E04F 15/04 52/588.1
2012/0066996 A1 3/2012 Konstanczak
2013/0067840 A1 3/2013 Martensson
2013/0276398 A1 * 10/2013 Hannig ..... C10L 11/04 52/588.1

FOREIGN PATENT DOCUMENTS

DE 202014008510 U1 12/2014
DE 102014114250 A1 3/2016
DE 202016105668 U1 11/2016
RU 2516618 C2 5/2014
WO 2015135533 A1 9/2015

* cited by examiner

PANEL

The present application is a 371 of International application PCT/EP2018/082383, filed Nov. 23, 2018, which claims priority of EP 17203608.9, filed Nov. 24, 2017, the priority of these applications is hereby claimed and these applications are incorporated herein by reference.

BACKGROUND OF THE INVENTION

The invention concerns a panel comprising a panel core, a panel top surface, a lower panel surface and at least one first edge pair of complementary positively locking holding profiles at mutually opposite panel edges, wherein one of the holding profiles has a locking groove with a distally projecting upper groove wall and a lower groove wall which projects distally further than the upper groove wall, and comprising a holding bar which projects at the free end of the lower groove wall in the direction of the panel top surface and has a free upper bar end and at least one undercut holding surface, wherein said holding surface is directed towards the panel core and delimits in the lower groove wall a recess which is behind the holding bar, wherein the complementary holding profile is provided with a locking tongue which has at least one undercut contact surface which is directed towards the panel core and in the assembled condition co-operates with the holding surface of the holding bar, wherein the locking tongue has a tongue underside and a tongue top side of which the tongue top side has a distal end and a proximal end and is straight or curved and is arranged inclinedly relative to the perpendicular on the panel top surface so that the distal end is further away from the panel top surface and the proximal end reaches closer to the panel top surface, wherein in the assembled state there is a play which includes a vertical play and a horizontal play so that the holding profiles are movable perpendicularly to the panel top surface and are movable in a direction which is perpendicular to the panel edges and at the same time parallel to the panel top surface, wherein an inside of the upper groove wall is of a straight or curved shape matching the tongue top side and relative to the perpendicular to the panel surface has an angle of inclination which is such that the inclined tongue top side and the inside of the upper groove wall are in surface contact in the mutually displaced state.

A state of the art of the general kind set forth is known from DE 10 2014 114 250 A1. That proposes a panel which is provided with a tongue top side inclined out of the perpendicular and in the assembled state has a play within the positively locking locking means. Because of the play interengagement and locking is somewhat simpler than in the case of panels which have the positively locking means without play. Because of the play the panel is also suitable for a floatingly laid floor. In regard to floating laying account is to be taken of the fact that the panels are constantly subjected to a variation in the ambient conditions like a change in temperature and air humidity. Such changes in ambient conditions lead to shrinkage or expansion effects of the panels, which can be compensated by the play within the assembled locking means. That also applies to panels intended as wall cladding/wall covering. The term horizontal play relates to a horizontal application of the panels for a floor. The play referred to as the horizontal play may no longer be horizontally oriented in the case of a wall covering, but it is also advantageous here because it can compensate for shrinkage or expansion effects on the panels.

In practice the panel known from DE 10 2014 114 250 A1 is preferably used for thin floor or wall coverings, in which case the technology is turning away from a panel core of HDF or MDF as is usual in laminate panels. Instead the panel core for a thin panel is made in practice from a plastic material or a composite consisting of a plastic reinforced with fibres and/or containing other fillers.

In general the locking means have to be manufactured exactly so that they fit together and they must also retain their dimensional stability. In that respect the material of the panel core is exposed and unprotected on the positively locking means. The thinner the panels are, the more difficult it is to ensure dimensional stability. Just minor defects can mean that the locking means no longer fit together.

Because panels with positively locking means are delicate they have to be carefully handled as soon as they are removed from their packaging. In rough operating conditions on a building site there is always a risk of damaging the locking means.

As mentioned the known panel is preferably made with a panel core of plastic and generally is of a smaller overall thickness than for example usual laminate panels which have a panel core of MDF or HDF.

The known panel with panel core of plastic is also produced in a large format, for example in the format measuring 40×80 cm or even 40×120 cm. In that case the thinnest panels at the present time are produced in such a way that their overall thickness is only 3.2 mm. What is problematical is handling of such large panels because there is a long lever if the workman lifts the panel from the support surface at one end and the locking means is to be brought into positively locking engagement at the other end, in which case the support surface can be both a floor and also a wall. Joining the small positively locking means together by interengagement is difficult. They can assume a tilted position relative to each other, which is difficult for the layer/workman to see and is scarcely perceptible. That can lead to fractures on the locking means. If in contrast the panel is very small, for example 10×30 cm then handling is much easier because the workman can grip the panel with the hands much closer to the locking means and can see and feel them. The risk of damage to the locking means is then slight.

SUMMARY OF THE INVENTION

The object of the invention is to develop the known panel in such a way that it is less at risk of suffering damage, more specifically even when the panel is of a large format and/or is of a small overall thickness.

According to the invention the object is attained in that an edge break is provided between the free upper bar end of the holding bar and its lower holding surface, wherein the edge break forms a free surface which has a distal upper end and a proximal end and is of a straight or curved shape, and wherein the free surface has an angle of inclination β relative to the perpendicular on the panel top surface, with the proviso that in a joining step the tongue underside of the locking tongue can be placed on the holding bar of the locking groove and then the tongue top side is slidable against the inside of the upper groove wall and that at the end of said joining step the distal end of the tongue top side contacts the inside of the upper groove wall in the region of the panel core.

The new panel which has a tongue top side inclined from the perpendicular and in the assembled state has a play within the positively locking means has the advantage that it can be locked almost horizontally, that is to say lying in the panel plane.

For that purpose the locking means are of such a configuration that the tongue underside of a new panel can be laid on the holding bar of a lying panel and the holding profiles are then movable towards each other by displacement of the panel in a direction parallel to the panel plane, in which case the tongue top side is movable closer and closer to the inside of the upper groove wall and is finally overlapped by the inside of the upper groove wall without necessarily already coming into contact therewith.

If a new panel is to be locked to a previous panel which is already on a support surface (floor or wall) then the new panel can be laid or moved into position such that its tongue underside rests on the holding bar of the previous panel. In that case the new panel can be deflected somewhat towards the opposite panel edge and a deflected part can also lie on the support surface. The flexural deflection of the new panel is slight, and is correspondingly less, the larger the format of the new panel, that is to say the further the mutually opposite holding profiles are spaced away from each other. The overlap of the tongue top side by the inside of the upper groove wall is not substantially impaired by slight flexing of the new panel.

The novel configuration is highly desirable for panels of small overall thickness and for large-format panels because, for the locking action, it is no longer necessary to fit the new panel in an inclined relationship, as the state of the art in DE 10 2014 114 250 A1 provides (for example FIG. 8*a*). Consequently there is also no need for a pivotal movement down on to the support surface which can lead to damage to the locking means having regard to the long lever when handling the panel, if the locking means are not guided into each other exactly but in a tilted position. The novel panel can afford large-format floor tiles as were hitherto not possible, with an edge length of 100×100 cm and more. Square large-format tiles have been tested and surprisingly successfully locked without damaging the holding profiles.

The novel panel is suitable for floating laying of floors, that is to say without bonding to the underlying surface, lying loosely thereon. In that case shrinkage and expansion of the panels, that can occur in practice, are compensated by the incorporated play.

On the other hand the panel is also highly advantageous if a floor or a wall covering is to be glued to the support surface for same. The joining operation which can be particularly easily implemented with the panel proposed here also favours that kind of laying because a panel which is to be locked can be laid only with the tongue underside on the holding bar of the previous panel and the lower panel surface can be laid overall on a support surface provided with adhesive. The further joining operation can then take place by sliding the panel towards the previous panel, in which case, as described above, the tongue underside of the locking tongue is pushed over the holding bar, then the free surface slides down and finally the tongue underside passes into the recess in the lower groove wall, where it rests on the contact surface thereof.

The configuration of the proposed panel self-evidently also makes it possible for a new such panel to be lifted a little and fitted inclinedly at a shallow angle if that is wanted. It is however in no way necessary to lift it high for the purposes of inclined fitment. Even when the panel is lifted inclinedly the locking tongue is brought into engagement with the locking groove in a more careful fashion. In addition the workman requires much less force for making a floor. That on the one hand is because he does not have to lift the panel so high and on the other hand because the operation of threading or joining the panels together takes place more quickly. In addition thereto, when dealing with a large-format panel, if it has to be lifted high it is more difficult to fit the locking tongue into the locking groove. The workman needs more time for that. He suffers fatigue if each panel has to be held up for a longer period of time and carefully and laboriously threaded into place.

In regard to the aspect whereby a panel is alternatively of such a configuration that it has to be lifted/angled in order to be able to connect the locking groove and the locking tongue together in positively locking relationship, that aspect is expressly viewed as an independent invention. That provides that the locking groove has a minimal opening between the distal end of the upper groove wall and the free surface, wherein the locking tongue does not pass through said minimal opening in a position in which its tongue top side bears in surface contact against the inside of the upper groove wall and wherein however at the same time the locking tongue is of such a configuration that it is of a smaller configuration for passing through the opening, which however passes through the minimal opening of the locking groove only when the panel is lifted/angled through an angle with γ the locking tongue.

All features which are described hereinafter and which relate to the first-mentioned structure involving horizontal lockability of the panel edges are hereby also proposed for combination with the structure which, for locking the panel edges, requires lifting/angling of a panel relative to the other panel.

Support plates of HDF or MDF or OSB plates can also be used as the starting material for the new panel. It can however also be for example a support plate comprising a wood-plastic composite, referred to as a wood particle composite (WPC) or a mineral composite, referred to as a mineral particle composite (MPC). The plastic used, whether pure or processed with said additives, can be a thermoplastic elastomeric or thermosetting plastic. For a support plate comprising an MPC, for example a composition of the MPC including talcum and polypropylene is highly suitable. It is further possible to use recycling material comprising the above-mentioned plastic examples.

Desirably provided at the front distal end of the locking tongue, that is to say at the tongue tip, there is a rounded configuration extending between the tongue top side and the tongue underside. Alternatively it is possible, instead of the rounded configuration, to provide a flattened surface or a surface with a preferably convex curvature.

Desirably the configuration is such that provided between the tongue underside and the undercut contact surface is an edge break which in relation to the edge break of the holding bar is of a cross-section which is at least 50% smaller. Such an edge break on the locking tongue protects the edge from damage. It has proven itself for that edge break to be relatively small because then more space remains for the undercut contact surface. The contact surface should be capable of extending as far as possible in the direction of the lower panel surface for, the larger the contact surface is, the more effective it is in opposing spreading movement of the panels in the panel plane and perpendicularly to the panel edges.

It is also possible to dispense with an edge break on the locking tongue in order thereby to maximise the height of the contact surface.

On the other hand the edge break can also have the same purpose as the free surface of the holding bar, namely providing space so that the locking tongue which is pushed over the holding bar can then go into a downward movement. The desired space can be provided by material being removed only on the holding bar or only on the locking tongue or by it being divided in the desired relationship with material being removed at both locations to produce edge breaks.

A further advantage is that the height of the free surface is ≥ the height of the holding surface of the holding bar. The larger the free surface, the more easily is it generally speaking possible to assemble the holding profiles.

Preferably a distal end of the tongue top side in the assembled state is on a level between the upper free bar end of the holding bar and a proximal end of the free surface or is above the free bar end by an amount corresponding to the height of the free surface. The sliding surface and the sliding zone are provided for the relative movement of the assembled panel edges within the limits of the horizontal play.

Desirably the tongue underside has a sliding surface which is arranged parallel to the panel top surface and in the assembled state is supported on a sliding zone in the recess of the upper groove wall, the sliding zone being arranged in turn parallel to the panel top surface.

It is helpful if the holding bar forms a contact surface on which the tongue underside can be placed at least during the joining operation and the locking tongue has a recess which is open towards the lower panel surface and has a bottom surface. In that way the holding bar in the assembled state of the locked panel edges has space on the recess of the locking tongue It is further advantageous if the contact surface of the holding bar and the base surface of the recess are in mutually parallel and contacting relationship in the assembled state so that within the existing play they act as sliding surfaces parallel to the panel top surface.

An improvement provides that the maximum vertical play Q, when the undercut holding surface of the locking groove and the undercut contact surface of the locking tongue are in contact, is in a ratio Q/S relative to the height S of the holding surface, that is in the range of 0.5-2.0, and preferably the ratio Q/S is in the range of 0.8-1.2. In that respect the height S of the holding surface is defined as the spacing of the upper end of the holding surface perpendicularly to the plane of the contact surface of the lower groove wall or the sliding zone. With a ratio ≥1.0 the locking tongue can be inserted without resistance into the locking groove until the tongue underside comes into contact with the support surface of the lower groove wall. If in contrast a ratio Q/S is selected, which is <1.0, then a certain elastic deformation of the holding profiles is required to assemble them. That can be achieved by region-wise compression and/or by region-wise bending, for example directed downwardly bending of the lower groove wall. Compression can preferably be effected at a rear region of the tongue underside, which during the joining movement comes into contact with the free surface.

Preferably the angle of inclination α of the inside of the upper groove wall relative to the perpendicular L on the panel top surface is in the range of 30° to 60°. Particularly preferably the angle of inclination α is 45°. It has been found that then the locking action can be easily produced and the positively locking engagement implemented achieves good strength.

Handling of the panel can be improved if the free surface of the holding bar is inclined through a free angle β relative to the perpendicular on the panel top surface and the free angle β is ≥ the angle of inclination α of the inside of the upper groove wall. This provides that there is a wedge-shaped narrowing opening for the locking groove, which simplifies introduction of the locking tongue.

Desirably the free angle β is in the range of 1.0 to 1.5 times the angle of inclination α. Preferably the free angle β is in the range of 1.1 to 1.3 times the angle of inclination α. It is alternatively also possible for the angle of inclination 3 to be < than the angle of inclination α, for example in the range of 0.7 to 1.0 times the angle of inclination α. In that way it is possible to achieve effects, for example the need for a certain degree of elastic deformation during the joining operation.

A second distal holding surface directed towards the panel core can be provided on the holding bar and the locking tongue in matching relationship therewith can have a proximal second contact surface. In the case of uneven support surface which has high and low locations it can happen that the assembled holding profiles are disposed at a high point in the support surface or at a low point therein. In that case two interlocked panels no longer form a flat surface. Instead, between the surface of the one panel and the surface of the other panel there is an angle which is >180 when a high spot on the support surface is involved and an angle of <180° when it is a low spot on the support surface. The proposed configuration of the panel with two holding surfaces on the holding bar and with two contact surfaces co-operating therewith on the locking tongue provides a remedy because a pair of holding surface/contact surface always remains in contact while the other pair of holding surface/contact surface can somewhat lose contact. The positively locking action however still remains effective.

The second holding surface of the holding bar is desirably arranged at the distal end of the free surface.

The panel top surface can have an edge break at least on the side of the locking groove or on the side of the locking tongue. It will be appreciated that both sides, locking groove and locking tongue, may also have an edge break.

It is advantageous if the panel is quadrangular and has a second edge pair which is provided at mutually opposite panel edges with complementary holding profiles, said holding profiles being identical to the holding profiles of the first edge pair.

In addition there is provided a method of laying and locking panels which has an edge pair with complementary holding profiles according to the invention, wherein the tongue underside of a new panel is laid on the holding bar of a panel which is already lying on a support surface, then the new panel is displaced lying in the panel plane perpendicularly to the panel edge against the lying panel until the tongue underside of the new panel has moved beyond the holding bar of the lying panel and moves downwardly into the recess behind the holding bar.

Furthermore there is proposed a method of laying and locking quadrangular panels having two identical edge pairs. In that case a new quadrangular panel of said type having two identical edge pairs is locked in a second panel row with panels of an existing first panel row and at the same time locked to a panel already present in the second row by the new panel being placed with a tongue underside of a locking tongue on the holding bars of the panels of the first panel row and with the tongue underside of its adjacent locking tongue on the holding bar of the panel already present in the second row, then the new panel is displaced in a diagonal direction whereby its two adjacent locking tongues are simultaneously brought into engagement, namely the locking tongue with the locking groove of the panels in the first panel row and the other locking tongue with the locking groove of the panel already present in the second row, wherein the tongue undersides of the two adjacent locking tongues of the new panel have moved beyond the holding bars of the laid panel and move downwardly into the respective recess behind the holding bar. In that way two panel edges of the new panel are virtually simultaneously locked. Its panel edges can naturally be of differing lengths. The result of this can be that locking of the one panel edge of the new panel is finished earlier and the locking edge of its other panel edge is finished somewhat later. At least it is possible to achieve time overlapping of the locking operations for the two panel edges of the new panel.

The proposed panel can be used to produce a covering surface in a herringbone laying pattern. For that purpose two different types of panel are required, a type A and a type B. The two panel types A and B have an edge pair of an identical configuration, that is to say the locking groove of type A is arranged on the same panel edge as in the case of panel type B and likewise the locking tongue of type A is arranged on the same panel edge as in the case of panel type B. However, the other edge pair is side-reversed in type B relative to type A, that is to say that panel edge which in type A is provided with the locking tongue has the locking groove in type B and vice-versa. In the present example both types have a pair of long panel edges and a pair of short panel edges. The long panel edges are of an identical configuration in type A as in type B. The short panel edges differ. At that panel edge at which type A has the locking tongue type B has the locking groove. Where type A has the locking groove type B in turn has the locking tongue.

In production of the panels type A and B the holding profiles of the long edges are firstly milled. Then the panels are further transported within the production installation to mill the short edges, in which case half of the panels of a batch have to be turned through 180° prior to the milling operation to produce the short edges on that part of the panels in side-reversed relationship. That laying pattern means that long panel edges and short panel edges can be locked together. Different edge pairs, for example a long edge and a short edge therefore have to be milled at least in mutually compatible relationship. In the simplest situation the long edges and the short edges can be milled with the same or identical tools. In that way it is possible to produce a herringbone laying pattern. What is particular therein is that, in spite of the special laying pattern, the panels are lockable in positively locking relationship on all sides, wherein a locking action is achieved in the panel plane (horizontally), more particularly perpendicularly to the locked edges but also a locking action in a direction perpendicular to the panel plane (vertically). In the case of a rectangular or square panel the horizontal and vertical locking effect is therefore possible at both edge pairs.

The invention is illustrated by way of example hereinafter in a drawing and described in detail by means of a number of embodiments by way of example.

DETAILED DESCRIPTION OF THE INVENTION

FIGS. 1*a*-1*f* show a first embodiment of a panel 1 according to the invention. The panel is shown in a disassembled state in each case to illustrate its oppositely disposed panel edges 2 and 2' in the course of the joining movement/joining process and to show it in the locked state. It will be appreciated that the panel edges which are shown portion-wise can also be interpreted as a portion-wise view of two panels which are not cut off.

In practice, if the panels are for example of a rectangular format, it is entirely usual for a panel which is excessively long at the end of a row of panels to be cut off to shorten it to the required length. In general a new row of panels can be begun with the cut-off remaining portion. Complementary holding profiles of a cut-off panel fit together and can be locked together, as illustrated in the following examples.

Figure 1A:
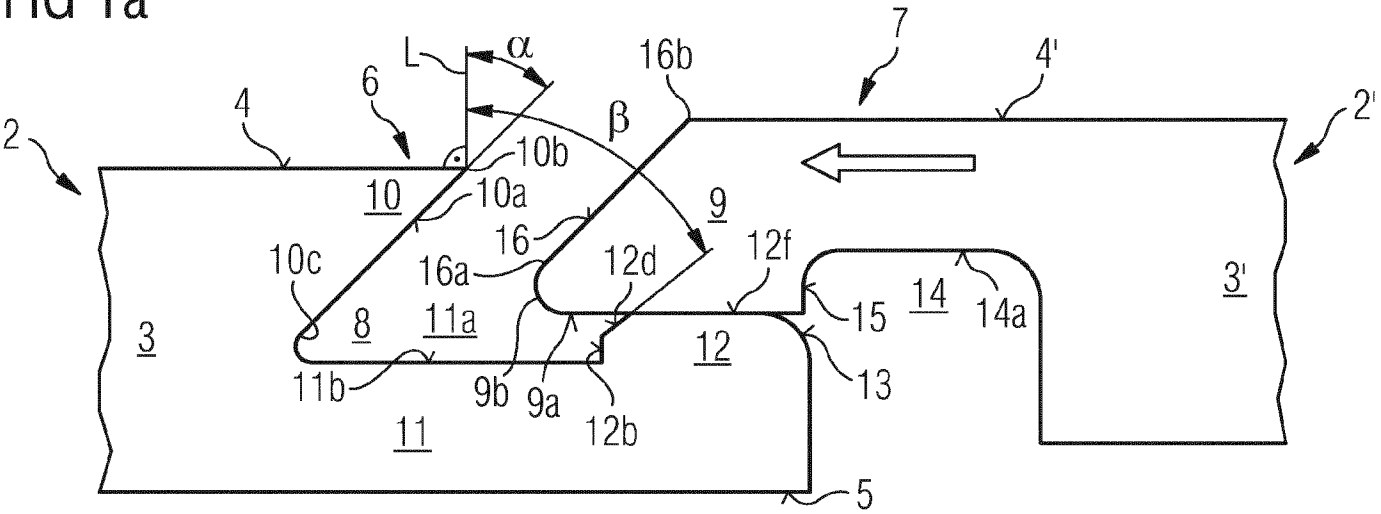
FIG. 1*a* shows a first embodiment of a panel according to the invention, the panel being shown in an exploded view, to illustrate its complementary holding profiles of an edge pair in the course of a joining movement.

FIG. 1*a* shows the panel 1 with a panel core 3, wherein the panel has a panel top surface 4 and a lower panel surface 5 as well as a pair of complementary holding profiles 6 and 7 at the mutually opposite panel edges 2 and 2', the holding profiles being of a positively locking configuration.

A holding profile 6 is provided with a locking groove 8 and the holding profile 7 complementary thereto has a locking tongue 9. The locking groove has an upper groove wall 10 and a lower groove wall 11 which projects distally further from the panel core 3 than the upper groove wall. Provided distally, that is to say at the free end of the lower groove wall, is a holding bar 12 which in turn projects in the direction of the panel top surface 4 and has a free upper bar end 12*a* and a holding surface 12*b*, the holding surface being directed towards the panel core 3. Provided behind that holding surface, that is to say towards the panel core, is a recess 11*a* in the lower groove wall, which has a contact surface 11*b* arranged parallel to the panel top surface 4 for the locking tongue 9. The recess 11*a* is delimited outwardly by the holding bar 12 and by the holding surface 12*b* thereof. A radius 13 is provided between the bar end 12*a* and the outwardly facing side of the holding bar 12.

The upper groove wall 10 has an inside 10*a* which is arranged inclinedly and more specifically it is arranged inclinedly relative to the perpendicular L to the panel top surface 4. It has an angle of inclination α so that a distal end 10*b* of the inside extends to the panel top surface 4 and the proximal end 10*c* of the inside is further away from the panel top surface and is oriented close to a central plane of the panel core 3. In this arrangement the central plane of the panel core can also be exceeded by a little.

It serves overall to constitute the strength of the locking action if substantial surface areas of the holding profiles like the tongue top side and the inside of the upper groove wall, in relation to the panel thickness, extend into a central panel thickness region or respectively extend close to the region on both sides of the central plane of the panel core 3 or pass through that central plane. This preferably also applies to the holding surface 12*b* of the holding bar which in accordance with the invention extends at least close to the central plane of the panel core and is arranged in a central panel thickness region.

The locking tongue 9 has a tongue underside 9*a* arranged parallel to the panel top surface 4'. Proximally associated with the locking tongue is a downwardly open recess 14 which in the assembled state of the panel edges 2/2' provides space for the holding bar 12. The locking tongue is further provided with an undercut contact surface 15 which in the assembled state co-operates with the holding surface 12*b* of the holding bar and it has a tongue top side 16 inclined with respect to the perpendicular to the panel top surface 4', wherein the angle of inclination is as great as the angle of inclination α of the inside 10*a* of the upper groove wall.

In FIG. 1*a* the tongue underside 9 of the locking tongue lies on the upper end 12*a* of the holding bar 12, arranged parallel to the panel top surface 4. That position is a good starting position for the further joining movement.

Figure 1B:
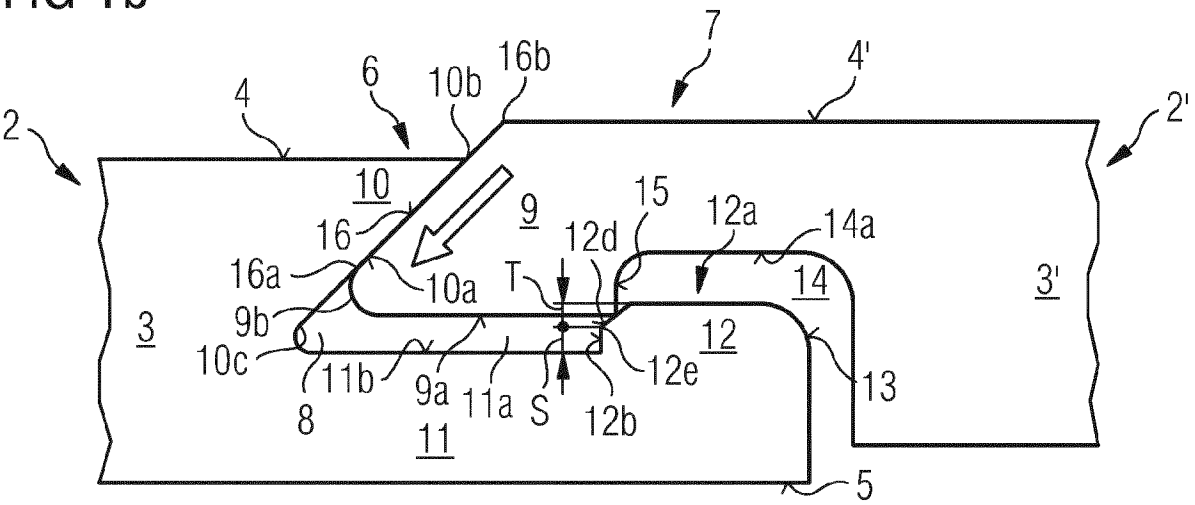
FIG. 1*b* shows the panel of FIG. 1*a* in an advanced stage in the joining movement.

FIG. 1*b* shows the further course of the joining movement. The tongue underside 9 has now passed the bar end 12*a* and is sliding down on an edge break or cut-off configuration 12*c* on the holding bar 12. The edge break forms a free surface 12*d* arranged through an angle of inclination 3 with respect to the perpendicular L on the panel top surface 4. The free surface 12*d* creates so much free space that a front distal end 9*b* of the locking tongue or the locking tongue overall can be moved unimpededly into the locking groove 8.

Figure 1C:
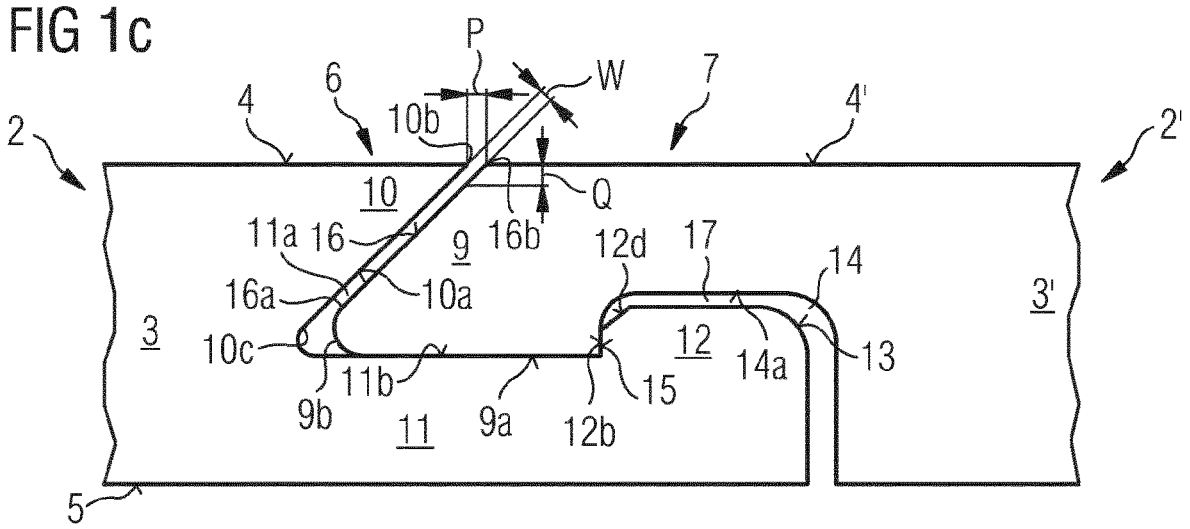
FIG. 1*c* shows the panel of FIG. 1*a* in the locked state with play and with the maximum gap at the panel top side.

The joining movement continues by the tongue underside 9*a* passing the free surface 12*d* and moving further down into the recess 11*a* in the lower groove wall 11 as shown in FIG. 1*c*. As a result the tongue underside 9*a* lies on the contact surface 11*b* of the lower groove wall and the undercut contact surface 15 of the locking tongue is in contact with the associated holding surface 12*b* of the holding bar 12 of the lower groove wall. Formed between the tongue top side and the inside 10*a* of the upper groove wall is a maximum gap W which is narrower than the dimension of the play P.

Figure 1D:
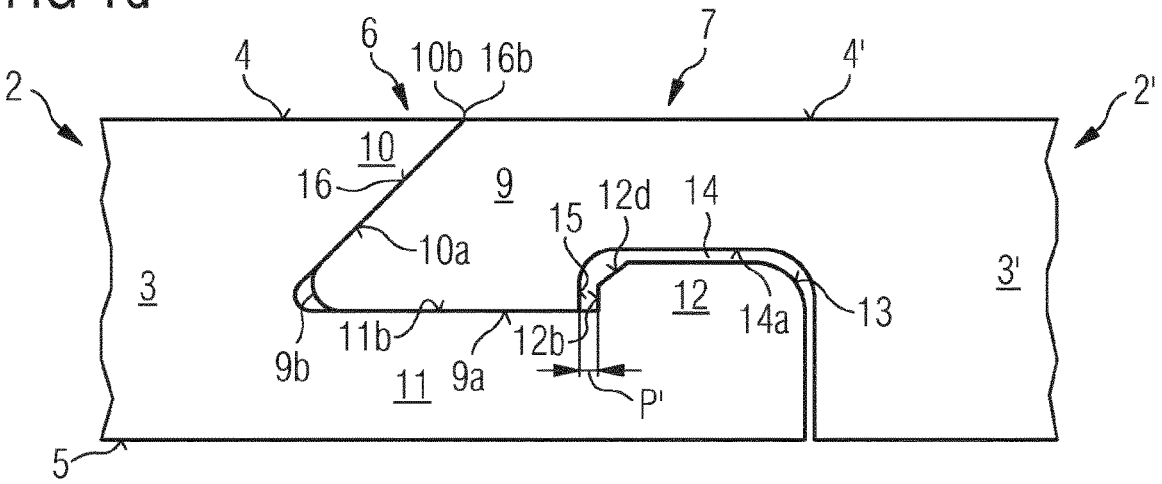
FIG. 1*d* shows the panel of FIG. 1*a* in the locked state with play and with the closed gap at the panel top side.

FIG. 1*c* shows a horizontal play P between the tongue top side 16 and the inside 10*a* of the upper groove wall. The play P allows the locking tongue 9 to move parallel to the panel top surface 4/4' deeper into the locking groove 8 until the play between the tongue top side and the inside of the upper groove wall is zero; the latter position is shown in FIG. 1*d*. For that purpose the contact surface 15 of the locking tongue has moved away from the holding surface 12*b* of the lower groove wall and horizontal play P' is thus created at that location. In this case the tongue underside 9*a* forms a sliding surface and the contact surface lib of the recess of the lower groove wall acts as a sliding zone within the limits of the existing horizontal play P/P'.

Figure 1E:
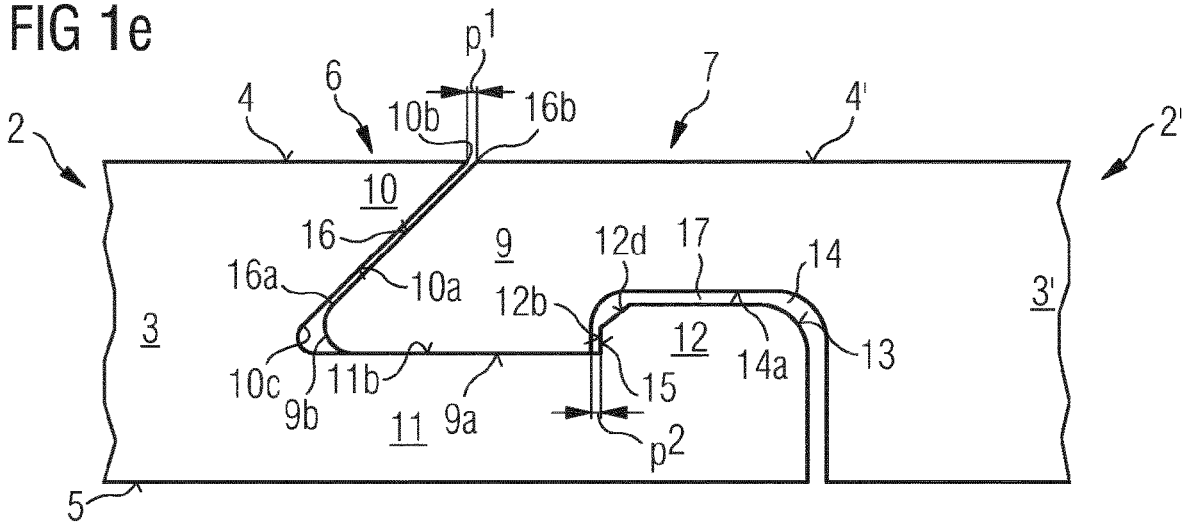
FIG. 1*e* shows the panel of FIG. 1*a* in a locked state in a central position in the limits of the existing plane.

The holding profiles can assume intermediate positions relative to each other. One intermediate position is shown in FIG. 1*e*. As shown therein there is a portion $p_1$ of horizontal play between the contact surface 15 and the holding surface 12*b*, and there is also a portion $p_2$ of the horizontal play between the tongue top side 16 and the inside 10*a* of the upper groove wall. Both play portions are added together to give the same magnitude as the horizontal play P/P' which occurs in FIGS. 1*c* and 1*d* only at one respective end.

FIGS. 1*c* and 1*e* show a vertical play or heightwise play Q, that is to say perpendicularly to the panel top surface. That vertical play is at a maximum when the undercut contact surface 15 and the holding surface 12*b* are in contact. When then the tongue underside 9*a* moves upwardly and lifts off the contact surface lib of the lower groove wall then, as shown in Figure if, there is a heightwise displacement K between the panel top surface 4 and the panel top surface 4'. The higher panel top surface 4' forms a small step involving an obtuse angle which affords a certain degree of stability because of its obtuse configuration.

In the foregoing embodiment by way of example the vertical play Q in the ratio to the height S of the holding surface Q/S=1.1. That ratio in effect creates an opening which is wider at the top and becomes narrower downwardly towards the lower groove wall. The locking tongue is thereby guided in the narrowing opening during the joining movement.

Two assembled panels ideally assume a position relative to each other, in which the panel top surface 4 of the one panel and the panel top surface 4' of the other panel include an angle of 180°, they then lie exactly in one plane. It can however occur if the support surface is uneven that the panel top surfaces 4/4' include an angle <180° or >180°, in which case the deviations from 180° can be about ±3°.

Figure 1F:
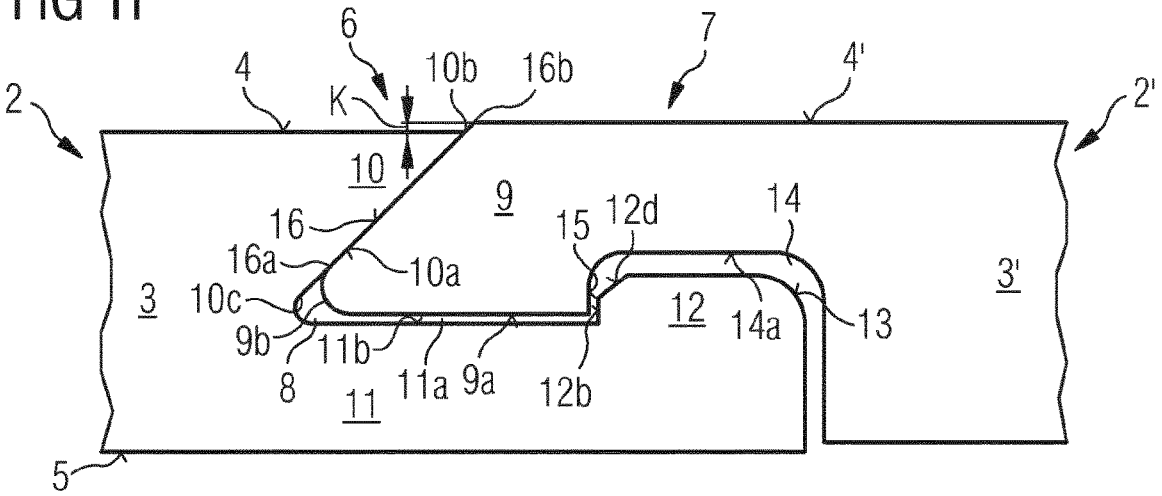
FIG. 1*f* shows the panel of FIG. 1*a* in the locked state with heightwise displacement.

In the assembled state as shown in FIGS. 1*d*-1*f* the holding bar 12 of the lower groove wall 11 respectively projects into the recess 14 of the locking tongue 9. In this embodiment however there is always a gap 17 between the free bar end 12*a* of the holding bar and the downwardly open recess 14. In the assembled state that facilitates horizontal mobility within the existing play P/P'.

In the first embodiment it is possible to dispense with a marked edge break between the tongue underside 9*a* and the contact surface 15 of the locking tongue. Instead an almost right-angled corner is formed. At the same time a right angle is also provided between the contact surface 11*b* of the lower groove wall 11 and the holding surface 12*b*. In practice that right angle of the lower groove wall will have a very small radius because the tools for producing that geometry do not have any sharp angles and such one-piece corners can be produced/milled only with minimal radii/edge breaks. So that the contact surface 15 and the holding surface 12*b* fit together the corner at the tongue underside 9*a* is also minimally rounded off or has a small bevel.

The free surface is of a height T which in the present embodiment is greater than the height S of the holding surface. In that arrangement a proximal end of the free surface coincides with an upper end 12*e* of the holding surface 12*b*. The term 'height S' is used to mean the spacing measured from the upper end 12*e* of the holding surface 12*b* to perpendicularly to the level of the contact surface lib of the lower groove wall 11.

The tongue top side 16 has a distal end 16*a* which in the assembled state of FIG. 1*c* is on a level between the upper free bar end 12*a* and an upper end 12*e* of the holding surface or is in the region of the height T of the free surface 12*d*.

The angle of inclination α of the inside of the upper groove wall in the present embodiment is 45° relative to the perpendicular L on the panel top surface 4.

The free angle β of the free surface of the holding bar in the present embodiment is 50° relative to the perpendicular L on the panel top surface 4.

A second embodiment is shown by means of FIGS. 2*a* to 2*f*. It differs in two aspects from the embodiment of previous Figure group 1. One aspect is the configuration of the panel top surface 4 on the side of the locking groove 8. Here an edge break 18 in the form of a bevel 18*a* is provided at the upper groove wall 10. As a result on the one hand the inside 10*a* of the upper groove wall 10 is shorter than in the embodiment of the previous Figure group. In addition a V-shaped joint gap 19 is formed in the assembled state. The V-shaped joint gap is viewed in many cases as being more pleasant. It also protects the free end of the upper groove wall 10 from damage. That free end is blunter and lower in comparison with FIG. 1*a*, that is to say it is a certain spacing away from the panel top surface 4 and is protected thereby.

The second aspect which is different from the embodiment of previous Figure group 1 is the ratio of the holding bar 12 to the downwardly open recess 14 in the locking tongue 9. It is provided here that the free end 12*a* of the holding bar forms a contact surface 12*f* which contacts the recess 14 at the bottom surface 14*a* and is supported there when the panels are assembled. In a movement within the limits of the horizontal play P/P' the bottom surface 14*a* of the recess 14 then slides on the contact surface 12*f*. That gives more stability if the panel is loaded from above on the panel top surface 4'.

Figure 2A:
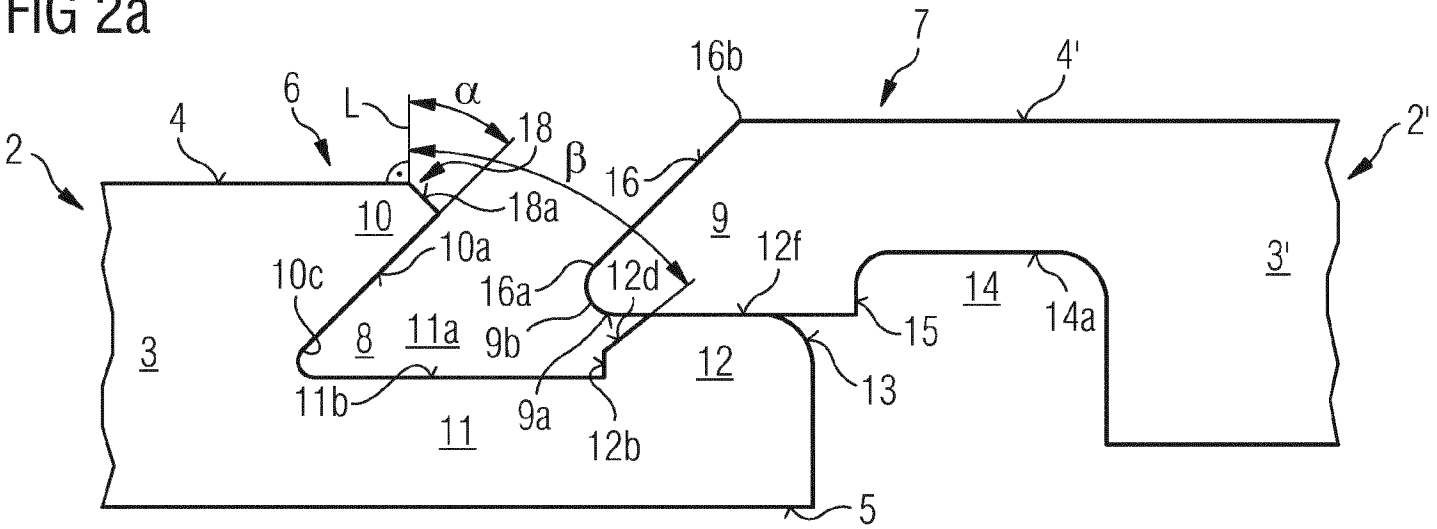
FIG. 2*a* shows a second embodiment of a panel according to the invention, the panel being shown in an exploded view, to illustrate its complementary holding profiles of an edge pair in the course of a joining movement.
Figure 2B:
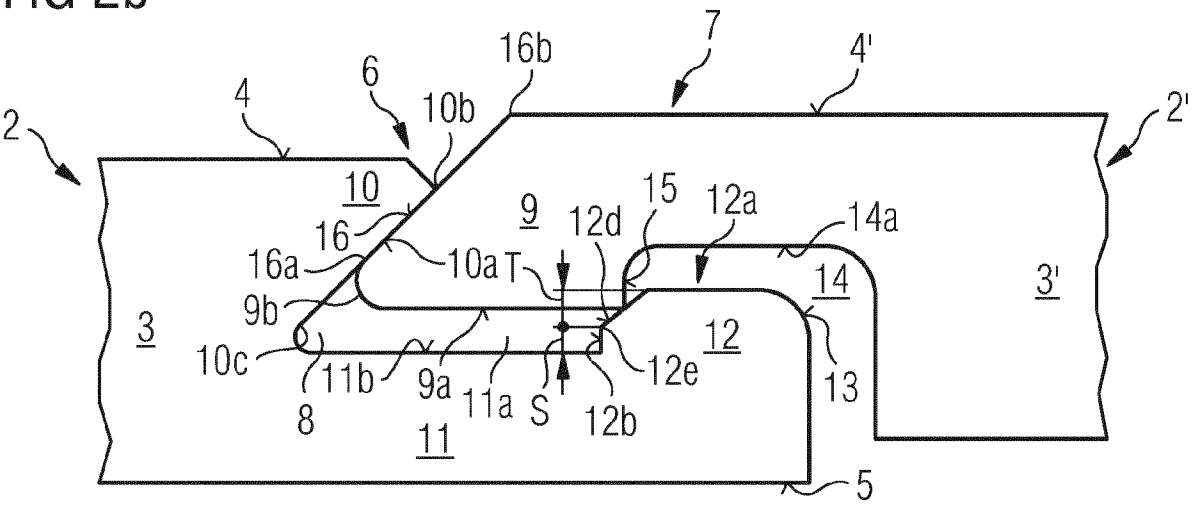
FIG. 2*b* shows the panel of FIG. 2*a* in an advanced stage in the joining movement.
Figure 2C:
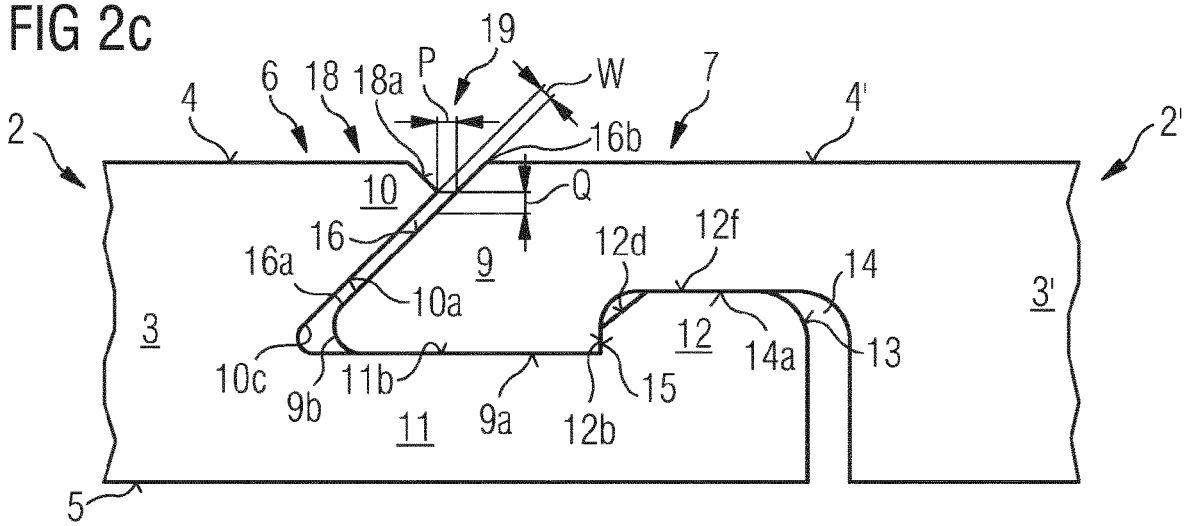
FIG. 2*c* shows the panel of FIG. 2*a* in the locked state with play and with the maximum gap at the panel top side.
Figure 2D:
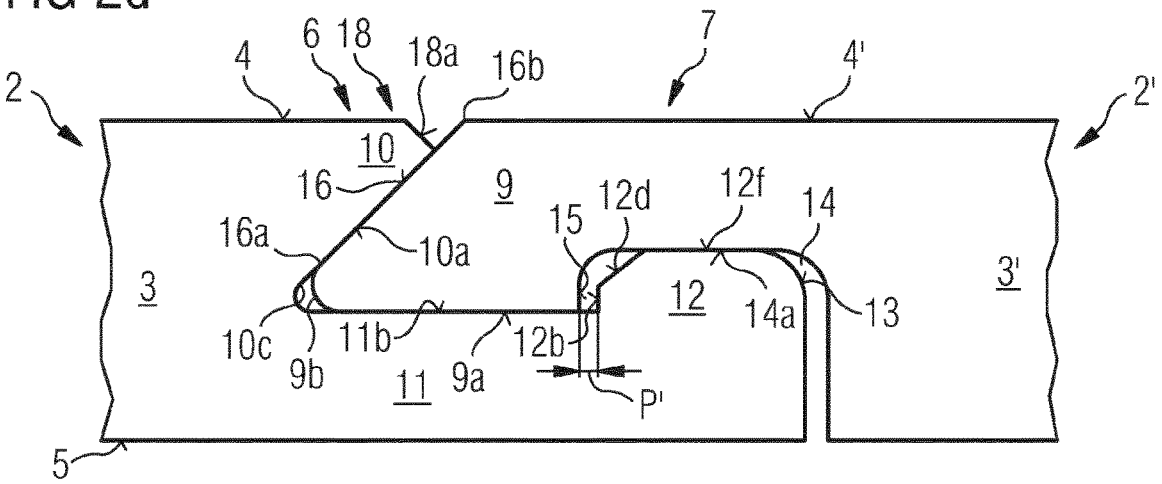
FIG. 2*d* shows the panel of FIG. 2*a* in the locked state with play and with the closed gap at the panel top side.
Figure 2E:
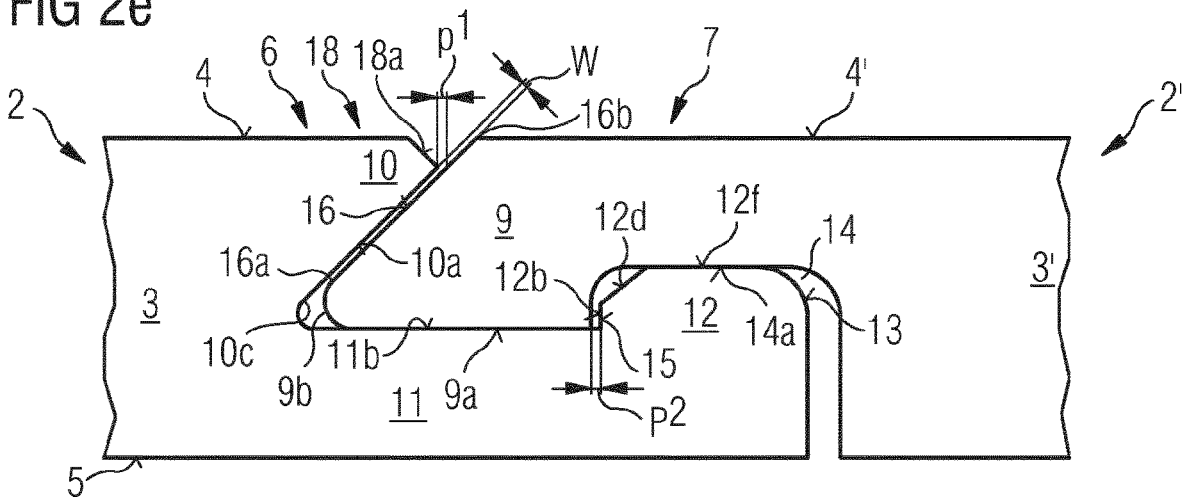
FIG. 2*e* shows the panel of FIG. 2*a* in the locked state in a central position in the limits of the existing plane.
Figure 2F:
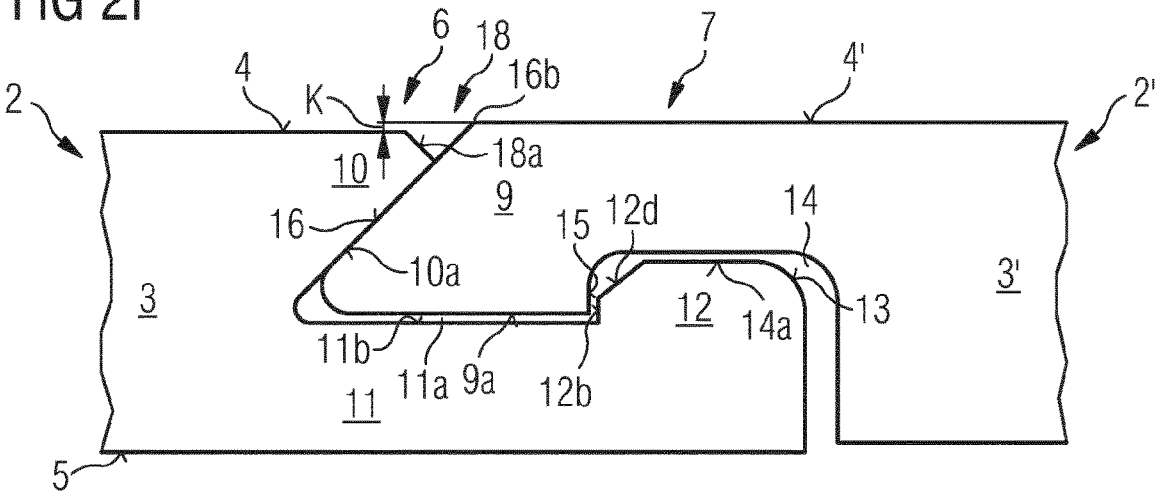
FIG. 2*f* shows the panel of FIG. 2*a* in the locked state with heightwise displacement.

In the position shown in FIG. 2*c* the distal end 16*a* of the tongue top side 16 in the assembled state is on a level which is between the upper free bar end 12*a* and the upper end 12*e* of the holding surface, or in the region of the height T of the free surface 12*d*. Once again, formed between the tongue top side and the inside 10*a* of the upper groove wall is a maximum gap W which is narrower than the dimension of the play P.

Figure 3A:
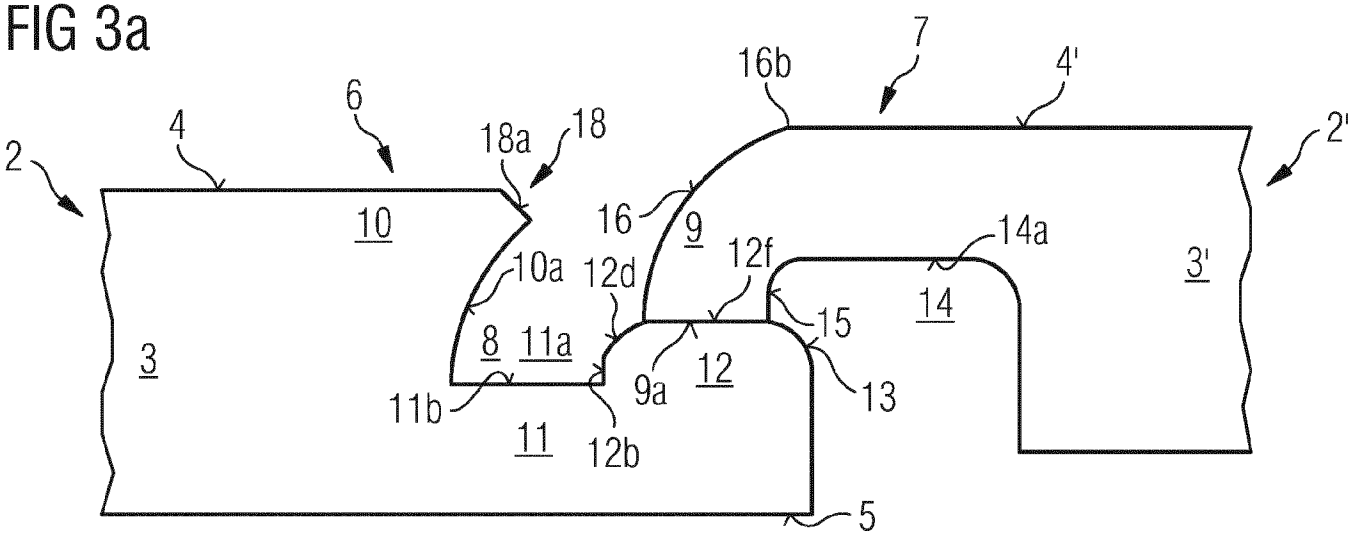
FIG. 3*a* shows a third embodiment of a panel according to the invention, the panel being shown in an exploded view, to illustrate its complementary holding profiles of an edge pair in the course of a joining movement.
Figure 3B:
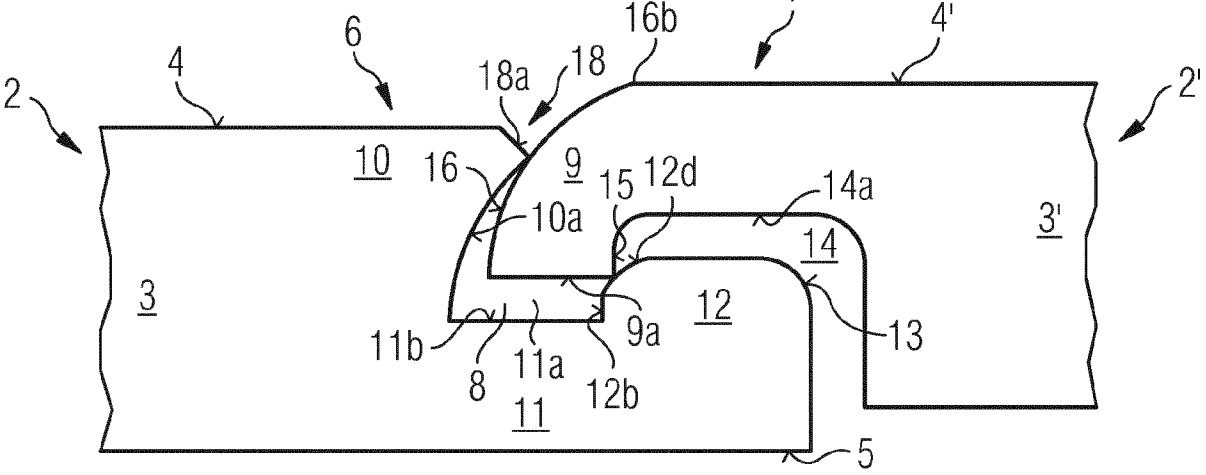
FIG. 3*b* shows the panel of FIG. 3*a* in an advanced stage in the joining movement.
Figure 3C:
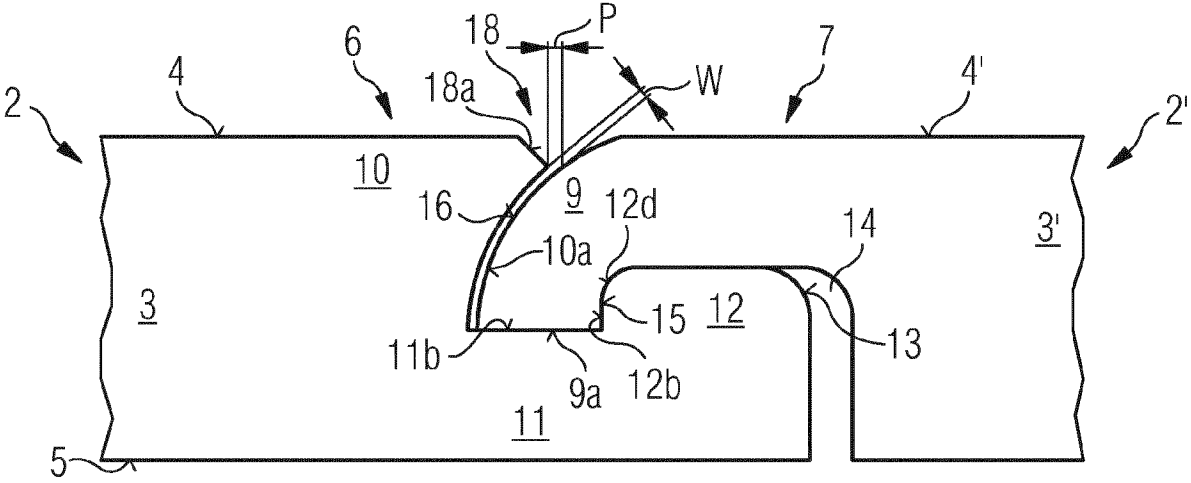
FIG. 3*c* shows the panel of FIG. 3*a* in the locked state with play and with the maximum gap at the panel top side.

A third embodiment is shown in FIGS. 3*a* to 3*c*. It substantially corresponds to the embodiment of Figure group 2. In the assembled state it forms a V-shaped joint gap 19 at the panel top surface. The holding bar 19 provided at the lower groove wall contacts the bottom surface 14*a* of the downwardly open recess 14 and supports that region of the locking tongue. A difference lies in the configuration of the tongue top side 16 which here has a region involving a convex curvature 20 (curve). In matching relationship therewith the inside 10*a* of the upper groove wall 10 has a concave curvature 21 (curve). In addition in this embodiment the free surface 12*d* has a curvature 22. The curvature 22 is inclined with respect to the perpendicular L on the panel top surface 4 at a somewhat greater angle than the inside of the upper groove wall. An opening is virtually formed between that inside and the free surface, which opening is of a greater width at the top and becomes progressively narrower downwardly towards the lower groove wall.

Figure 4A:
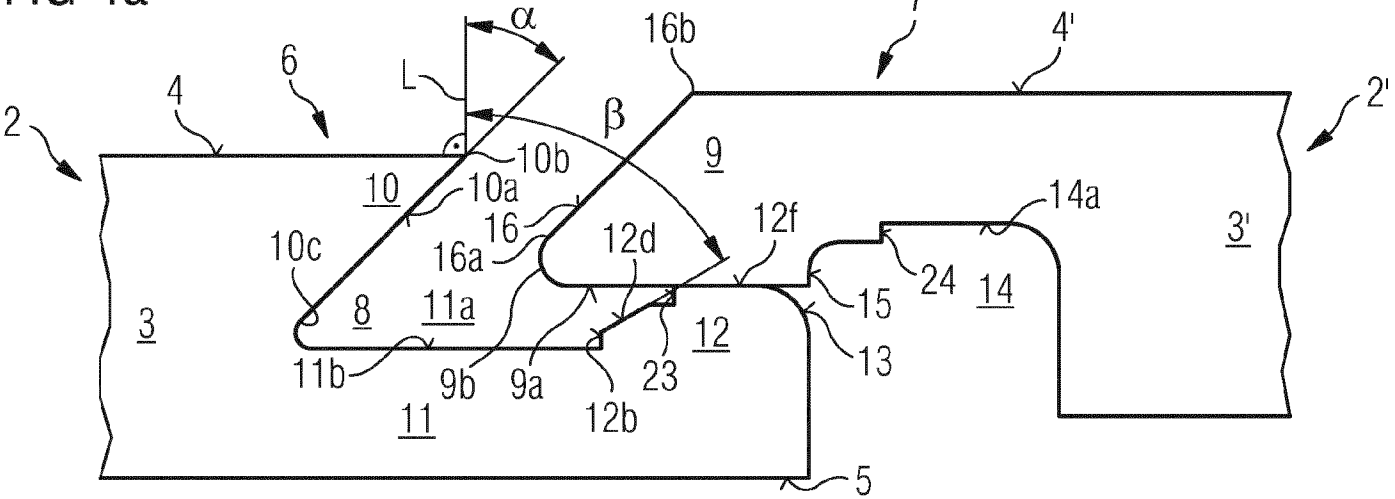
FIG. 4*a* shows a fourth embodiment of a panel according to the invention, the panel being shown in exploded view, to illustrate its complementary holding profiles of an edge pair in the course of a joining movement.
Figure 4B:
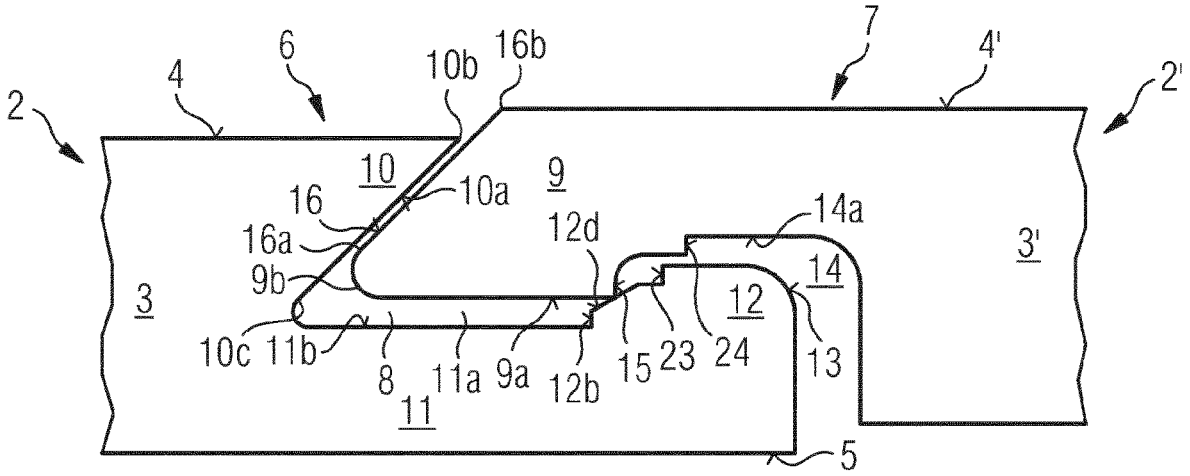
FIG. 4*b* shows the panel of FIG. 4*a* in an advanced stage in the joining movement.
Figure 4C:
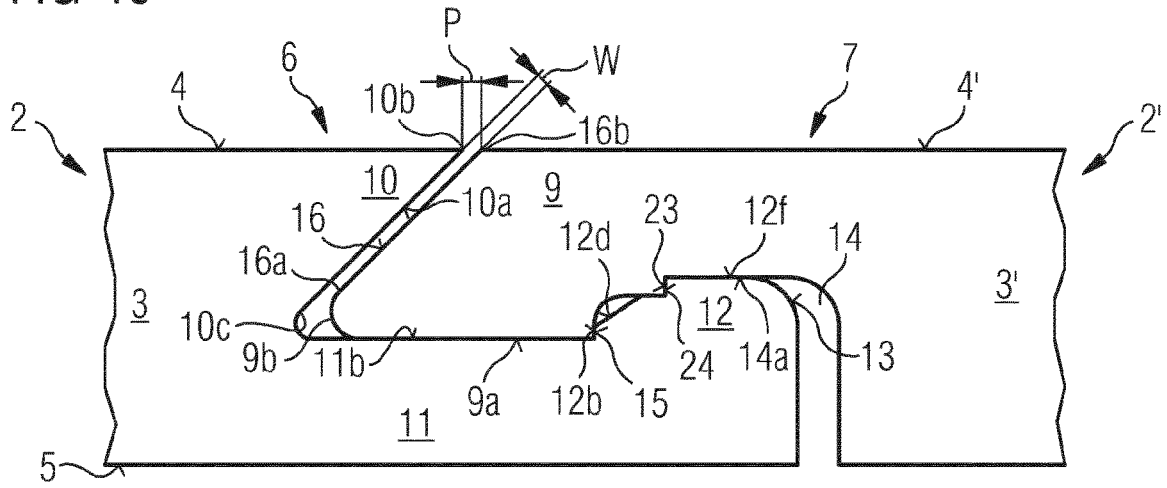
FIG. 4*c* shows the panel of FIG. 4*a* in the locked state with play and with the maximum gap at the panel top side.

A fourth embodiment is shown in FIGS. 4*a* to 4*c*. This is based on the embodiment of Figure group 2. Like it, at the panel top surface on the side of the locking groove it has a bevel 18*a* so that a V-shaped joint gap 19 is formed in the assembled state. In addition there is the common consideration that a downwardly open recess 14 of the locking tongue which in the assembled state in identical fashion as in FIG. 2 bears with a bottom surface 14*a* on a contact surface 12*f* of the holding bar 12 and is thereby supported.

The embodiment of Figure group 4 differs by a second holding surface 23 provided on the holding bar 12 of the lower groove wall 11 and a second contact surface 24 provided in matching relationship on the locking tongue 9. Two pairs of holding surface/contact surface are therefore operative. That duplication of the holding surface/contact surface overall improves the action of the locking arrangement in the assembled state. In the illustrated embodiment the second holding surface 23 starts at the upper end of the free surface 12*d* and ends at the free bar end 12*a* at the level of the contact surface 12*f* of the holding bar. The second contact surface 24 of the locking tongue is arranged proximally relative to the first contact surface 15 and in the assembled state fits together with the second holding surface 23 of the holding bar.

The configuration with the duplicated holding surfaces (12*b*/23) and contact surfaces (15/24) also has an advantage if the support surface U is uneven, that is to say if it involves a wavy configuration. The term wavy configuration is used to mean a moderate rise/fall in the support surface, of the order of magnitude of a maximum of ±3°. If two interlocked panels are laid and locked on such a wavy support surface then that no longer forms a flat floor surface. An angle of >180° is then formed between the panel top surface of the one panel and the panel top surface of the other panel if the holding profiles are at a raised point on the support surface. If they are at a low point on the support surface then an angle of <180° is formed between the two panel top surfaces. The proposed configuration of Figure group 4 gives the advantage that a respective one of the pairs of holding surface/contact surface remains in contact if the panel top surfaces of the locked panels are in a position of <180° or >180° relative to each other. A pair of holding surface/contact surface always remains in good contact with each other while the contact of the other pair of holding surface/contact surface is lost, in which case the degree of the loss of contact between holding surface/contact surface is however only tenths of a millimeter or indeed fractions of a tenth.

A fifth embodiment is again based on the embodiment of Figure group 2. As in that previous embodiment here too provided at the panel top surface 4 on that side of the locking groove 9 is an edge break 14, at the upper groove wall 10. The edge break is in the form of a bevel 18*a*. In addition in the assembled state there is contact between that downwardly open recess 14 associated with the locking tongue 9 and a contact surface 12*f* at the bar end 12*a* of the holding bar. The holding bar 12 projects into the recess 14 and is supported on the bottom surface 14*a* thereof.

The particularity of the fifth embodiment lies in the configuration of the tongue top side 16 which has a concave curvature 25 while the inside 10*a* of the upper groove wall 10 has a matching convex curvature 26. In the position shown in FIG. 5*c* the two curvatures 25/26 bear against each other. In contrast, a horizontal play P' can be seen between the holding surface 12*b* of the holding bar and the contact surface 15 of the locking tongue. It will be appreciated that the play P' can be reduced to zero whereby a play P is produced between the curvatures 25 and 26, like the play P in FIG. 2*c*.

Figure 5A:
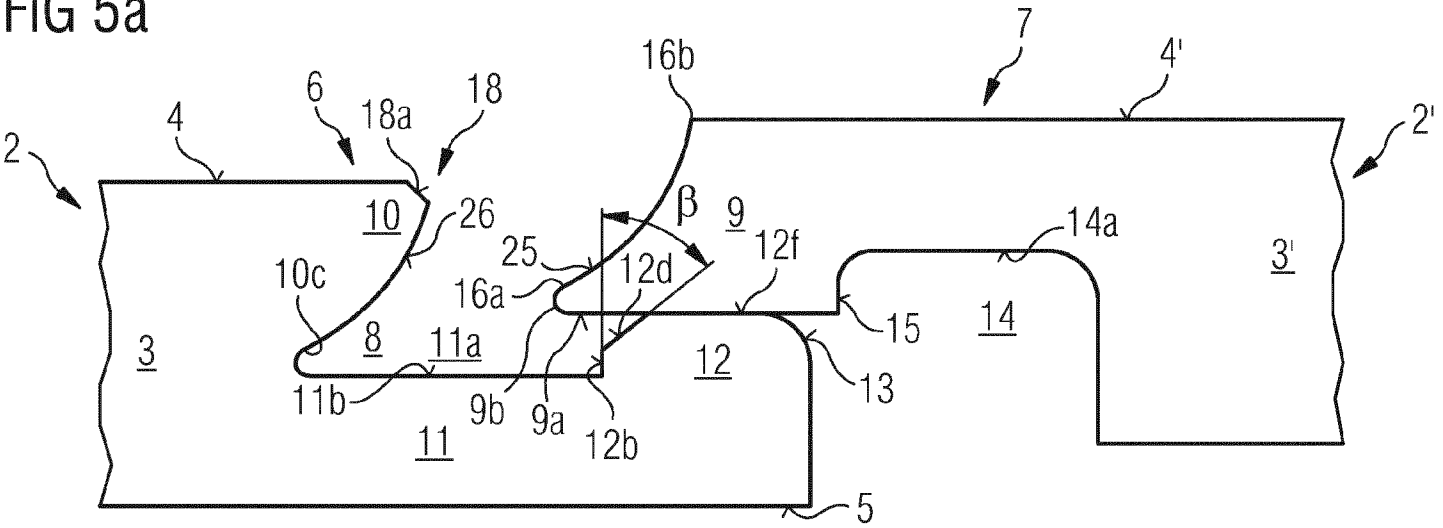
FIG. 5*a* shows a fifth embodiment of a panel according to the invention, the panel being shown in an exploded view, to illustrate its complementary holding profiles of an edge pair in the course of a joining movement.
Figure 5B:
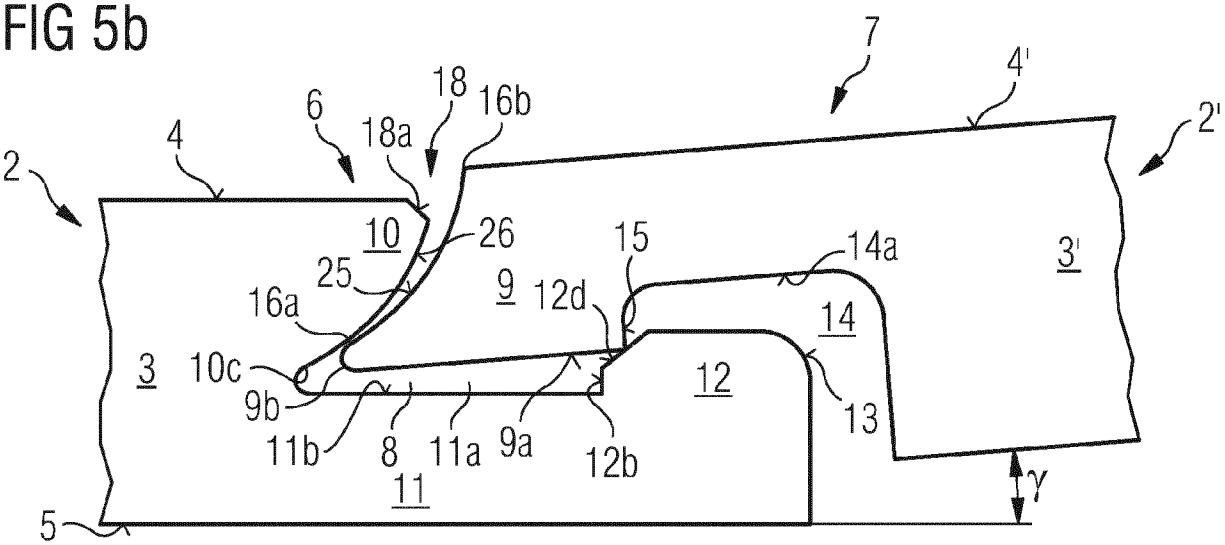
FIG. 5*b* shows the panel of FIG. 5*a* in an advanced stage in the joining movement.
Figure 5C:
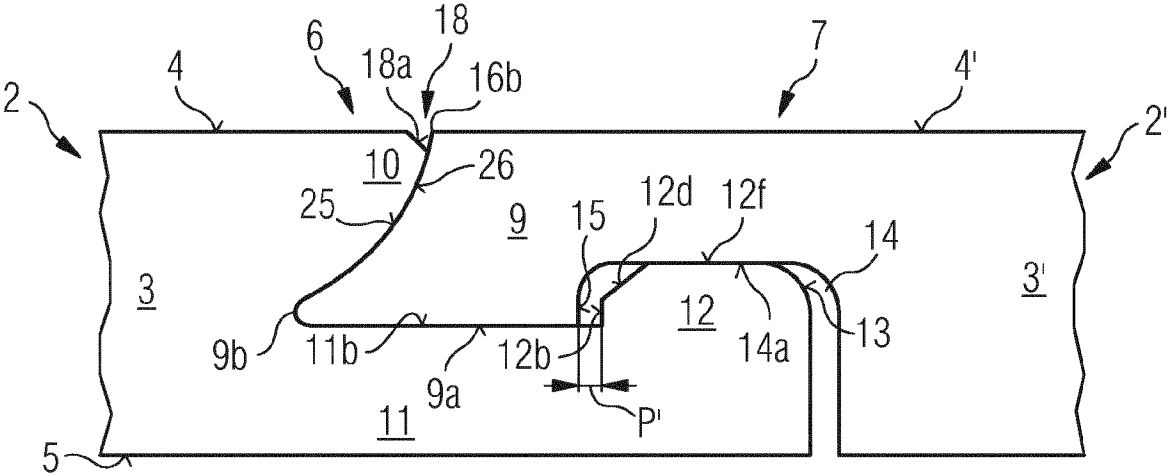
FIG. 5*c* shows the panel of FIG. 5*a* in the locked state with play and with the maximum gap at the panel top side.
Figure 6A:
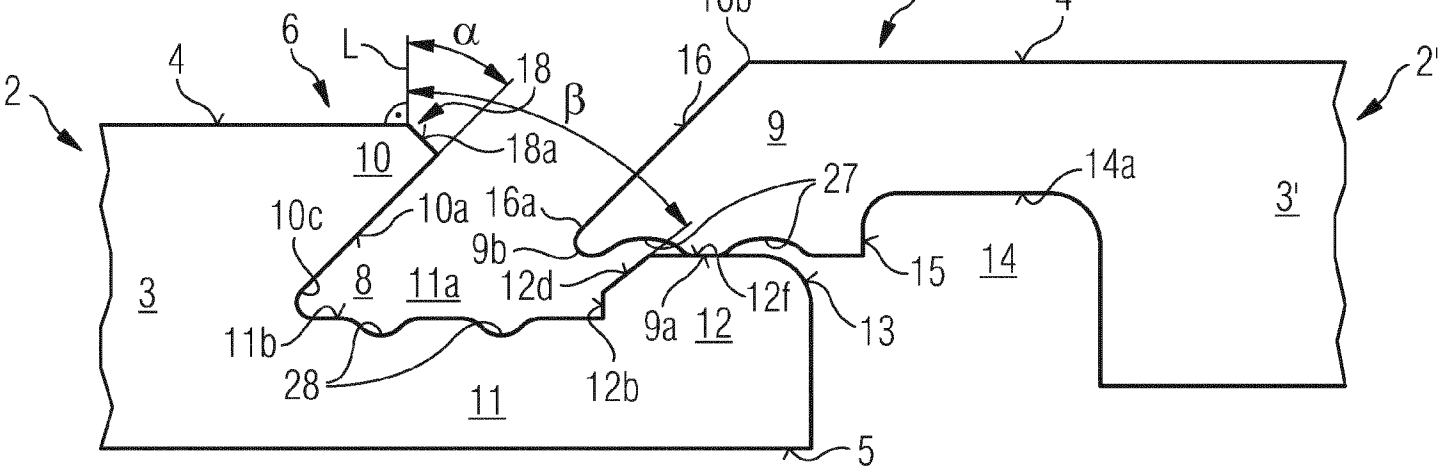
FIG. 6*a* shows a sixth embodiment of a panel.
Figure 6B:
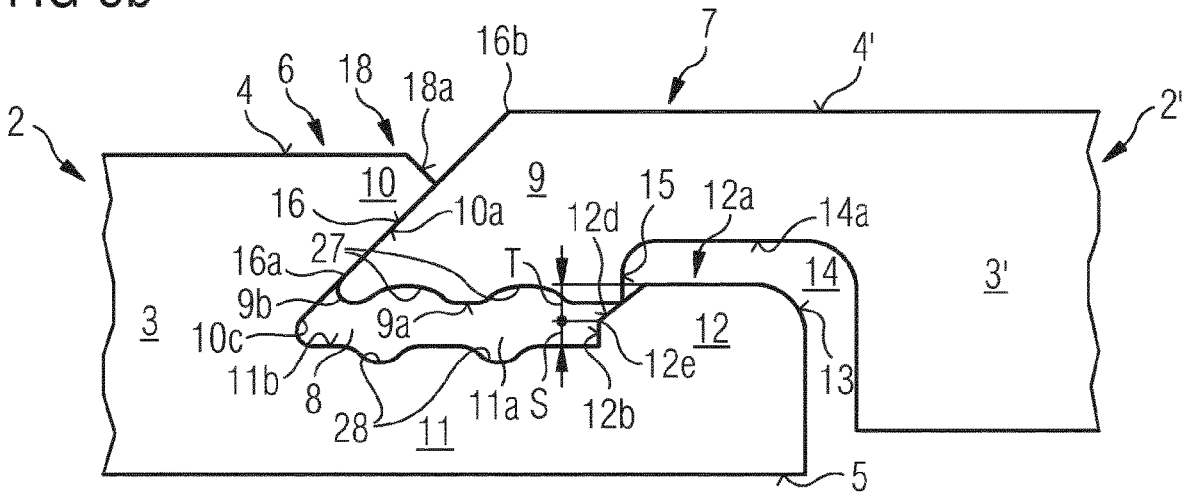
FIG. 6*b* shows the panel of FIG. 6*a* in an advanced stage of the joining movement.
Figure 6C:
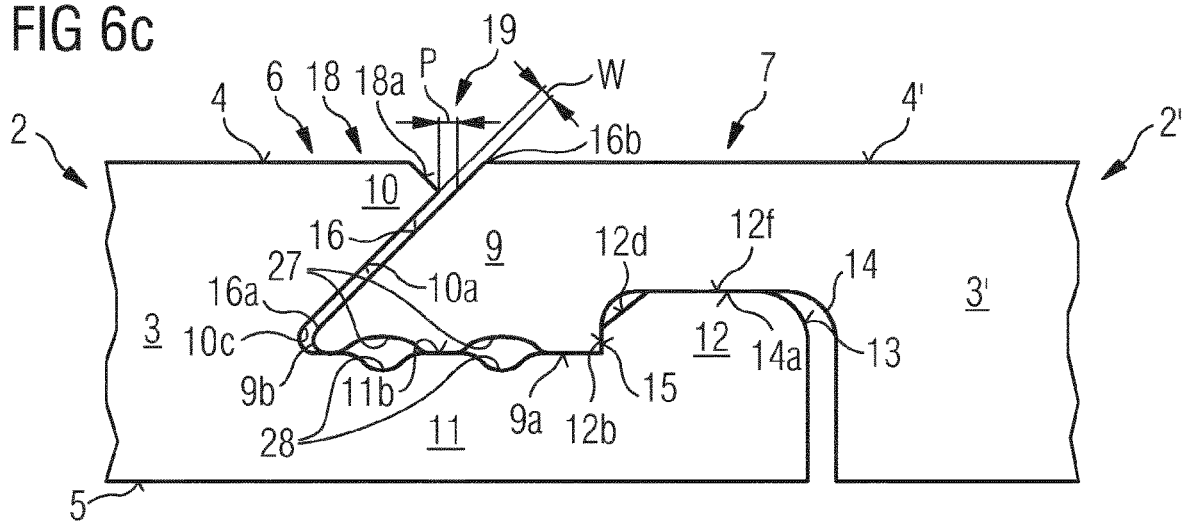
FIG. 6*c* shows the panel of FIG. 6*a* in the locked state with play and with maximum gap at the lower panel surface.

The joining operation is shown beginning with FIG. 5*a*. Just as shown in FIG. 2*a* it begins with placing the tongue underside 9*a* on the holding bar 12 and then displacing the locking tongue 9 further in the direction of the locking groove 8. As shown in FIG. 5*b* in this example the locking tongue 9 bears against the inside 10*a* of the upper groove wall. In the present example that requires lifting/angling of that panel with the locking tongue through a small angle γ. Alternatively however the configuration could also be modified and for example a larger play P could be provided to be able to insert the locking tongue 9 into the locking groove 8 with a lesser degree of angling or entirely without any angling.

A sixth embodiment is also based on Figure group 2. Like that, at the panel top surface 4 on each side of the locking groove 8 it has a bevel 18*a* so that a V-shaped joint gap 19 is formed in the assembled state. In addition as a common aspect there is a downwardly open recess 14 in the locking tongue 9, which in the assembled state bears in identical fashion as in FIG. 2*c* on the holding bar 12 and the bottom surface 14*a* thereof is supported thereby. What is new in the present embodiment is two recesses 27 in the tongue underside 9*a* and two recesses 28 in the contact surface lib of the lower groove wall. Each two recesses are in opposite relationship and jointly form hollow chambers Y in which for example dust or abrasive wear particles can collect. Alternatively it is possible to arrange at the tongue underside 9*a* or the contact surface lib fewer or more such recesses or to arrange recesses only at one side on the contact surface lib or the tongue underside 9*a*.

Figure group 7 shows an embodiment which once again is based on the embodiment of Figure group 2 because here too a bevel 18*a* is provided at the panel top surface 4 on that side of the locking groove 8 so that in the assembled state a V-shaped joint gap 19 is formed and because in common with FIG. 2 there is a downwardly open recess 14 in the locking tongue 9 which in the assembled state rests in identical fashion to FIG. 2*c* on the holding bar 12 and is supported thereby.

Figure 7A:
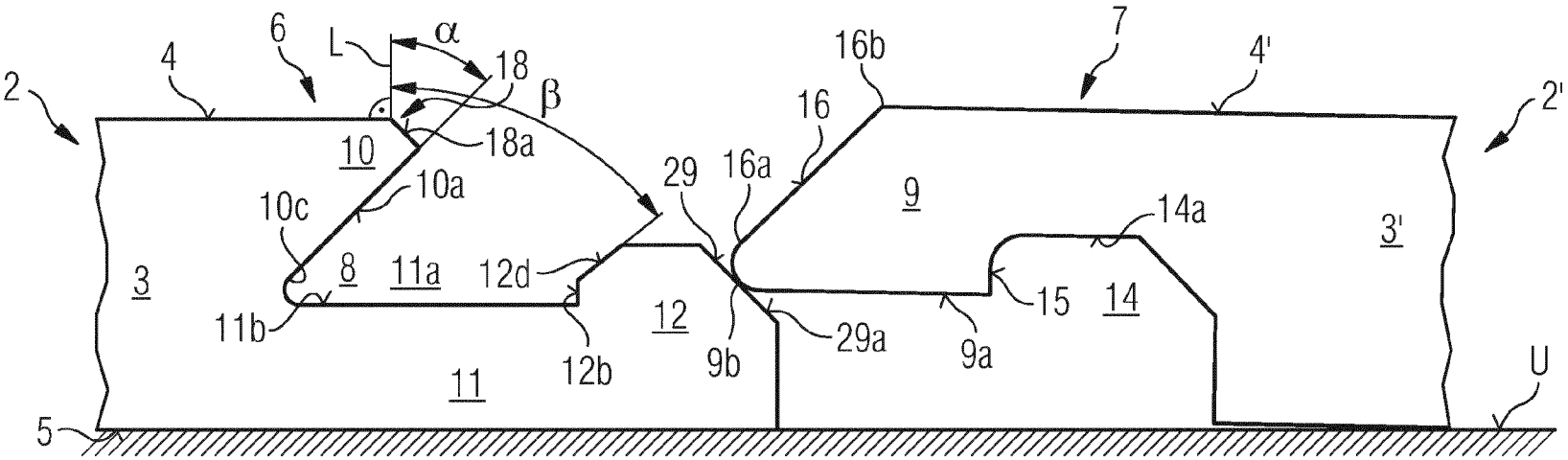
FIG. 7*a* shows a seventh embodiment of a panel according to the invention, the panel being shown in an exploded view, to illustrate its complementary holding profiles of an edge pair in the course of a joining movement.
Figure 7B:
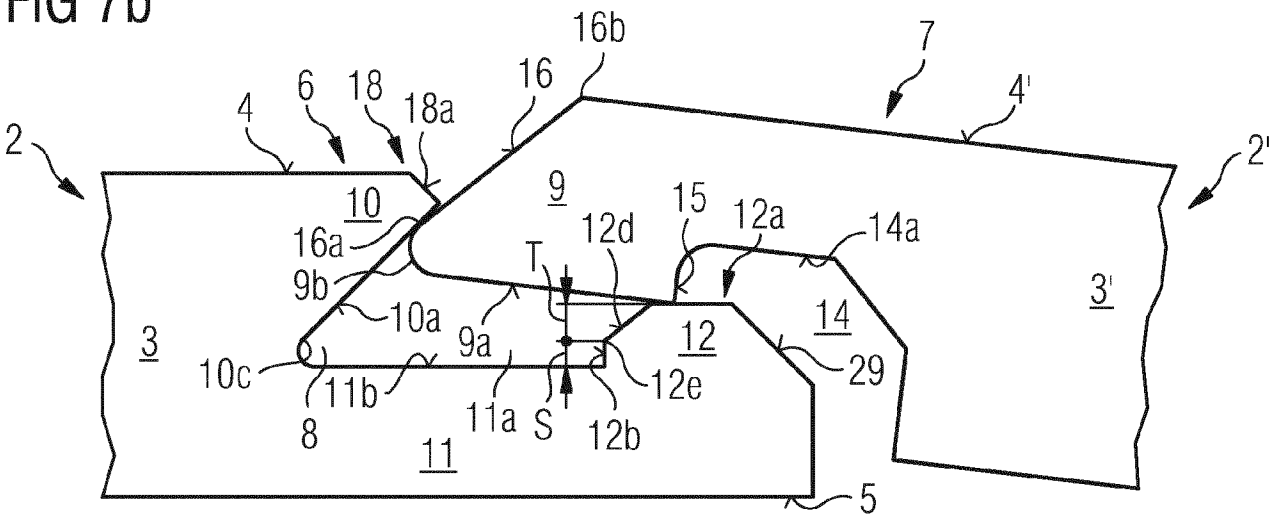
FIG. 7*b* shows the panel of FIG. 7*a* in an advance stage of the joining movement.
Figure 7C:
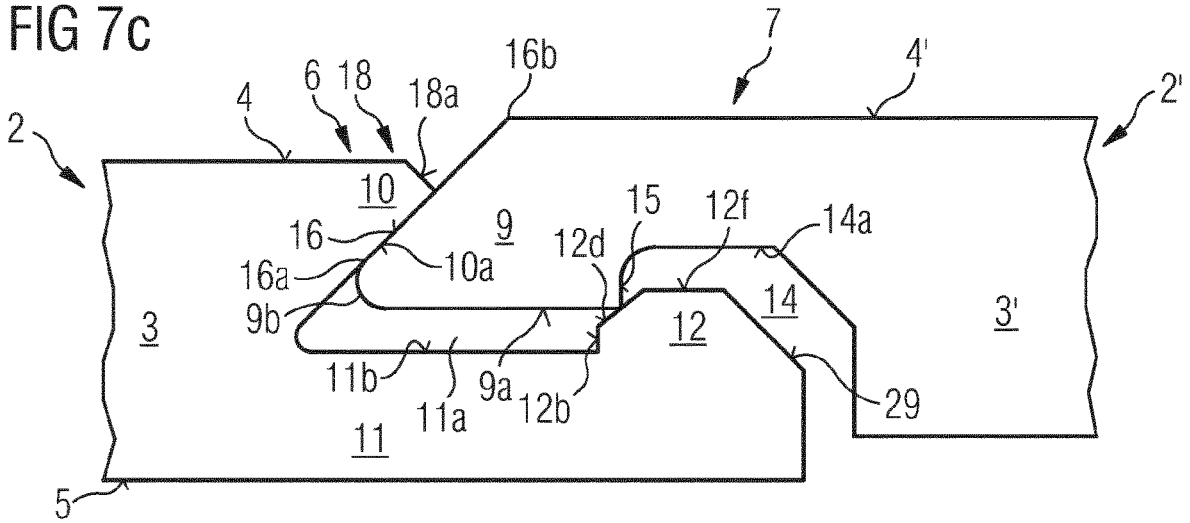
FIG. 7*c* shows the panel of FIG. 7*a* in the locked state with play and with maximum gap at the panel top side.
Figure 7D:
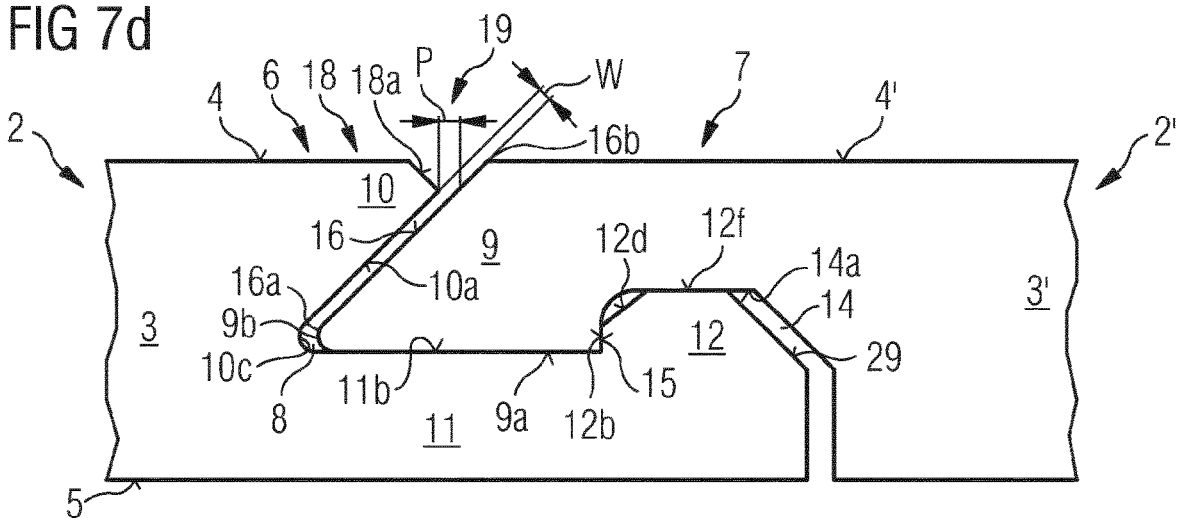
FIG. 7*d* shows the panel of FIG. 7*a* in the locked state with play and with closed gap at the panel top side.

In the present embodiment the holding bar 12 of the lower groove wall 11 is of a new configuration. More specifically, it is also provided with an edge break at its outside that is remote from the recess 11*a*. That edge break is of such a configuration that it serves as an inclined run-on surface 29 for the locking tongue 9, as indicated in FIG. 7*a*, where the tongue tip contacts the run-on surface and is moved upwardly along same. So that this is possible its distal end 29*a* extends down to a level which is sufficiently low so that the locking tongue 9 of a new panel can bear against the run-on surface when the new panel is resting on the support surface U. The new panel can then be further displaced out of that position in the direction of the locking groove whereby the locking tongue moves upwardly along the surface 29 until the tongue underside 9*a* comes to bear at the top on the holding bar 12 or on the contact surface 12*f* thereof. The further joining operation then takes place as in the embodiment shown in Figure group 2.

Figure 8A:
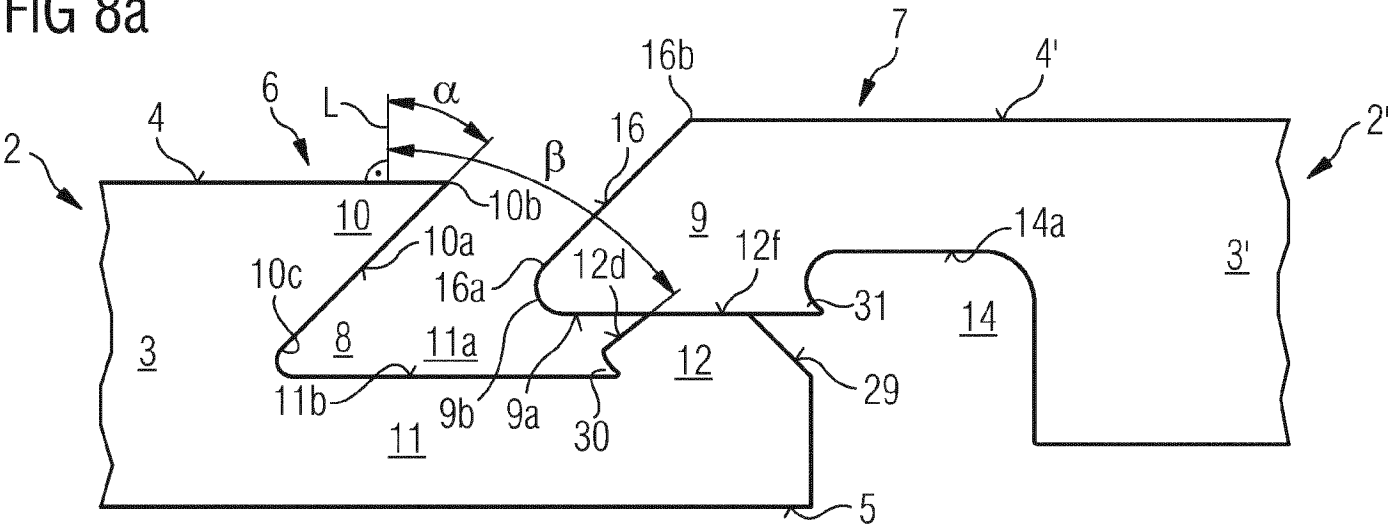
FIG. 8*a* shows an eighth embodiment of a panel according to the invention.
Figure 8B:
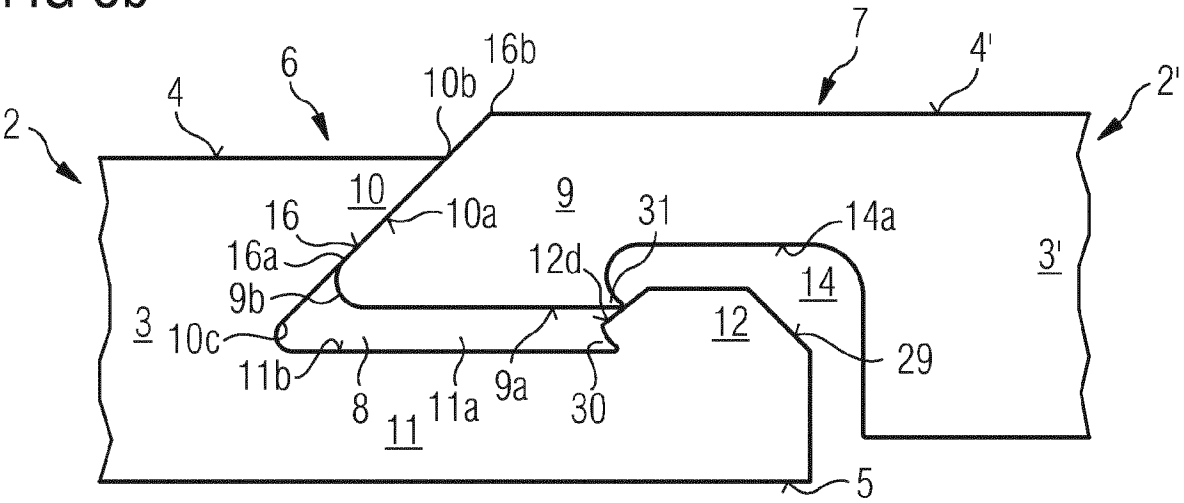
FIG. 8*b* shows the panel of FIG. 8*a* in the course of the joining movement.
Figure 8C:
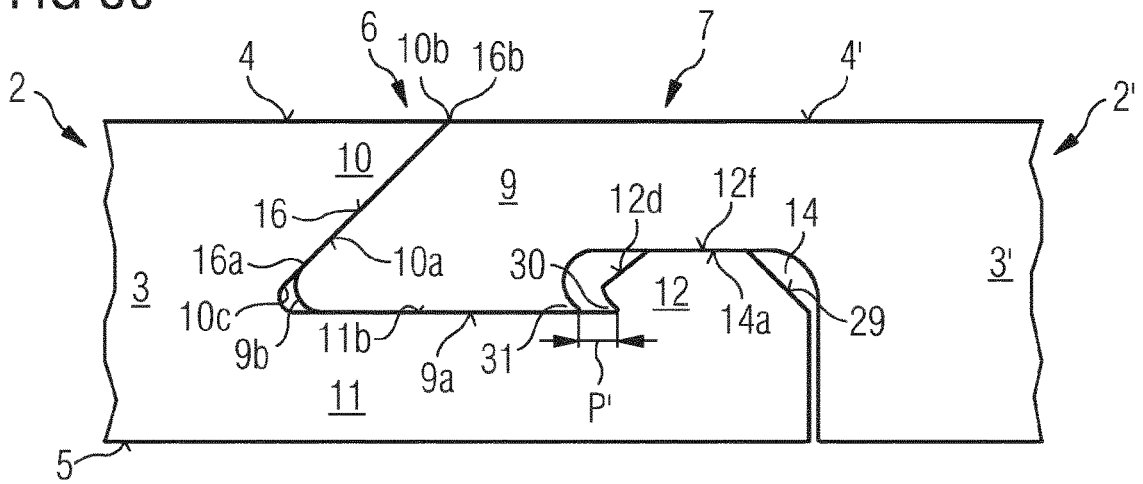
FIG. 8*c* shows the panel of FIG. 8*a* in the assembled state of the complementary holding profile.
Figure 8D:
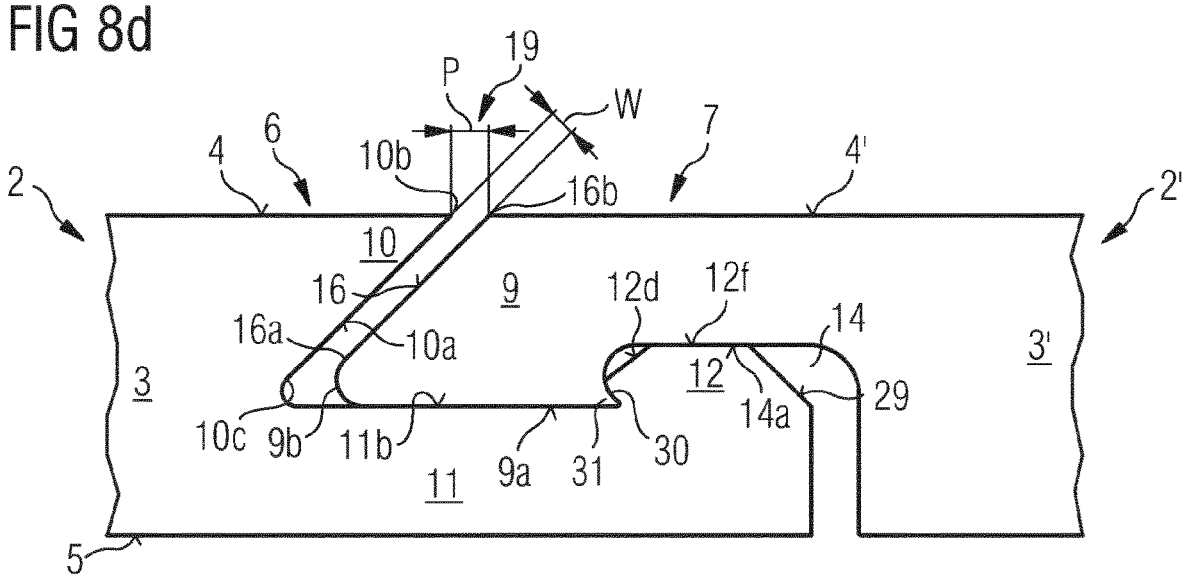
FIG. 8*d* shows the panel of FIG. 8*c* with projection and recess in engagement.

An eighth embodiment is shown in FIGS. 8*a* to 8*d*. It is based on that of the Figure group 1, in relation to which it is modified in two aspects. The first aspect is the modified relationship between the holding bar 12 provided at the lower groove wall 11, in relation to the downwardly open recess 14 in the locking tongue 9. The configuration is such that in the assembled state the recess lies on the contact surface 12*f*, as shown in FIGS. 8*c*/8*d*. The other aspect lies in the particular configuration of the holding surface 12*b*. As can be seen from FIG. 8*a* the holding surface is of an undercut configuration. It has a notch 30. The notch is so arranged that the contact surface 11*b* of the lower groove wall is prolonged and goes into the notch. The contact surface 15 of the locking tongue is developed to constitute a projection 31 which faces towards the panel core 3' and practically forms a prolongation of the tongue underside 9*a*. As shown in FIG. 8*d* the projection 31 is of such a configuration that in the assembled state it fits into the notch 31 and in the FIG. 8*d* position counteracts a heightwise displacement. In that way a rearward positive locking action is virtually provided behind the tongue underside 9*a*. In relation to the panel with the locking groove the rearward positive locking action is disposed at that side of the holding bar 12, that is towards the panel core. FIG. 8*b* shows an intermediate position during the joining movement. The tongue underside is moved downwardly along the free surface 12*d* or the above-mentioned projection 31 slides downwardly along the free surface. FIG. 8*c* shows the position with play P', in which the tongue top side 16 bears against the inside 10*a* of the upper groove wall.

Figure 9:
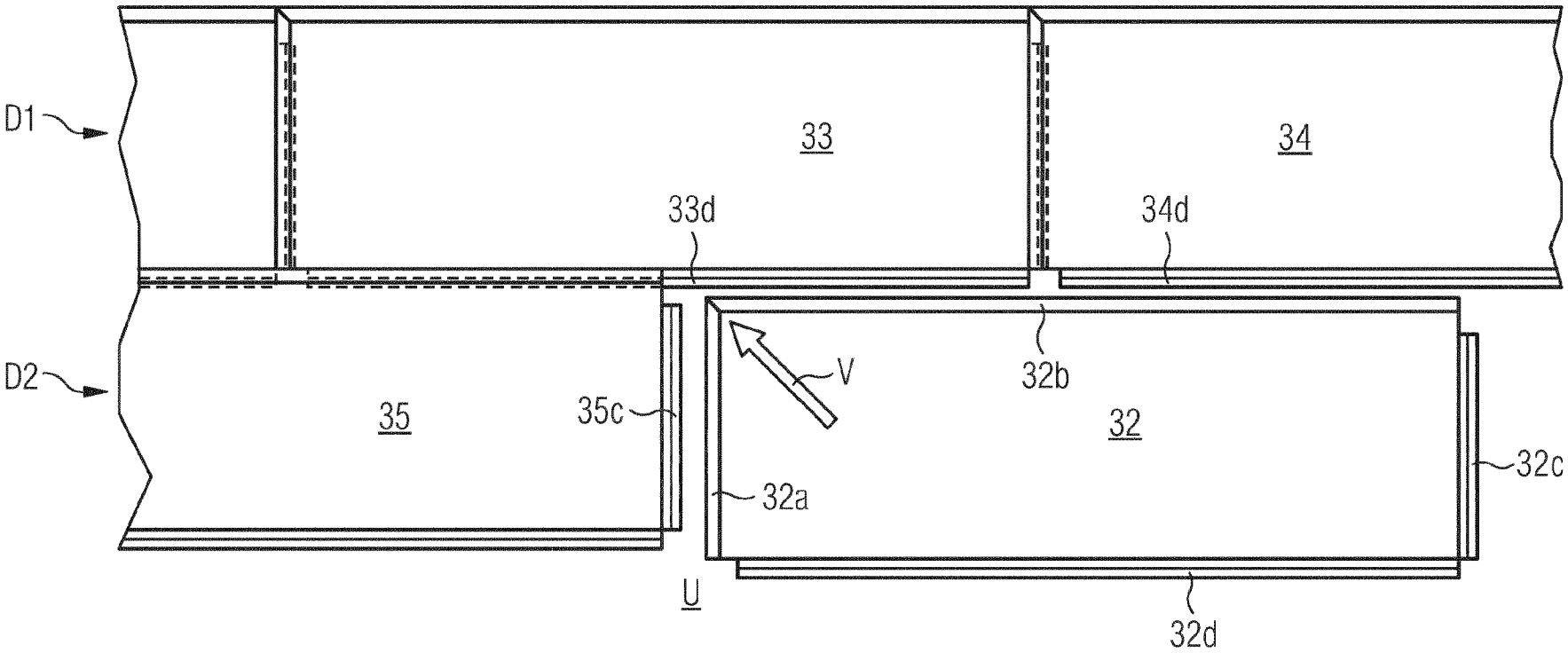
FIG. 9 shows a method of laying and locking a new panel of rectangular format.

FIG. 9 shows a plan view of a surface of laid panels, wherein panels of a rectangular format are being used here, which at both edge pairs have holding profiles as shown in Figure group 7. It is possible to see a first row of locked panels D1 and a second row of panels D2 which has been begun. The new panel has a first edge pair with a locking tongue 32*a* and in opposite relationship a locking groove 32*c* as well as a second edge pair with a locking tongue 32*b* and in opposite relationship a locking groove 32*d*.

A new panel 32 is to be connected in the second row of panels. For that purpose it has to be locked with panels 33 and 34 of the first row D1 and panels 35 of the second row D2. In accordance with the method described here the new panel 32 is placed on the support surface U. Next the new panel is moved in the direction of the arrow V (diagonally). In so doing it approaches the locking grooves of the panels 33/34 of the first row. At the same time it approaches the locking groove of the panel 35. At both sides to be locked of the new panel 32 its locking tongues 32*a* and 32*b* bear against run-on surfaces 35*b* or 33*b*/34*b* which are respectively provided externally on the holding bars of the adjacent panels 33, 34 and 35. In the further course of the movement in the direction of the arrow V the tongue undersides pass on to the holding bars or on to the contact surfaces thereof and then the tongue undersides slide down along the free surfaces and finally move down into the recess in the lower groove wall. That takes place both at the panels 33, 34 of the first row D1 and also at the panel 35 of the second row D2.

It will be appreciated that the above-described method step can be carried out in precisely the same way if the panels are to be glued to the support surface. When the new panel 32 is set down an adhesive has to be previously applied. The adhesive can be applied to the support surface and/or to the lower panel surface. It must have a sufficient pot life to be able to carry out all laying steps before it sets. After setting/bonding it produces a bonded join to the support surface U.

Locking of the two participating locking tongues 32*a*, 32*b* of the new panel is effected almost at the same time. However by virtue of the flexibility of the panel it can happen that locking of the locking tongue of the new panel to the locking groove of the panel or panels which have already been laid begins in that corner of the new panel, into which the arrow V is pointing, and, beginning in that panel corner, creation of the locking effect is progressively effected at both panel edges in the manner of a zip fastener. In that case it may be that one panel edge of the new panel is locked more quickly than the other; that for example when the panel edges are of differing lengths.

Alternatively it is possible to carry out another locking method which is required for those embodiments of the panel, which do not have any run-on surface externally on the holding bar so that the locking tongue cannot be moved automatically upwardly there by way of a run-on surface. Instead the new panel is set down in such a way that its locking tongues come to lie directly on the holding bars of the adjacent panels, as shown in FIGS. 1*a*, 2*a*, 3*a*, 4*a*, 6*a* and 8*a*. In other words, for FIG. 9, a locking tongue is placed on the holding bars of the panels of the first row and the other locking tongue is placed on the holding bar of the panel which is already present in the second row of panels. The panel is then pushed diagonally, as indicated by the direction of the arrow V, so that the new panel comes into positively locking engagement at both panel edges to be locked, with the locking grooves of the adjacent panels.

Figure 10:
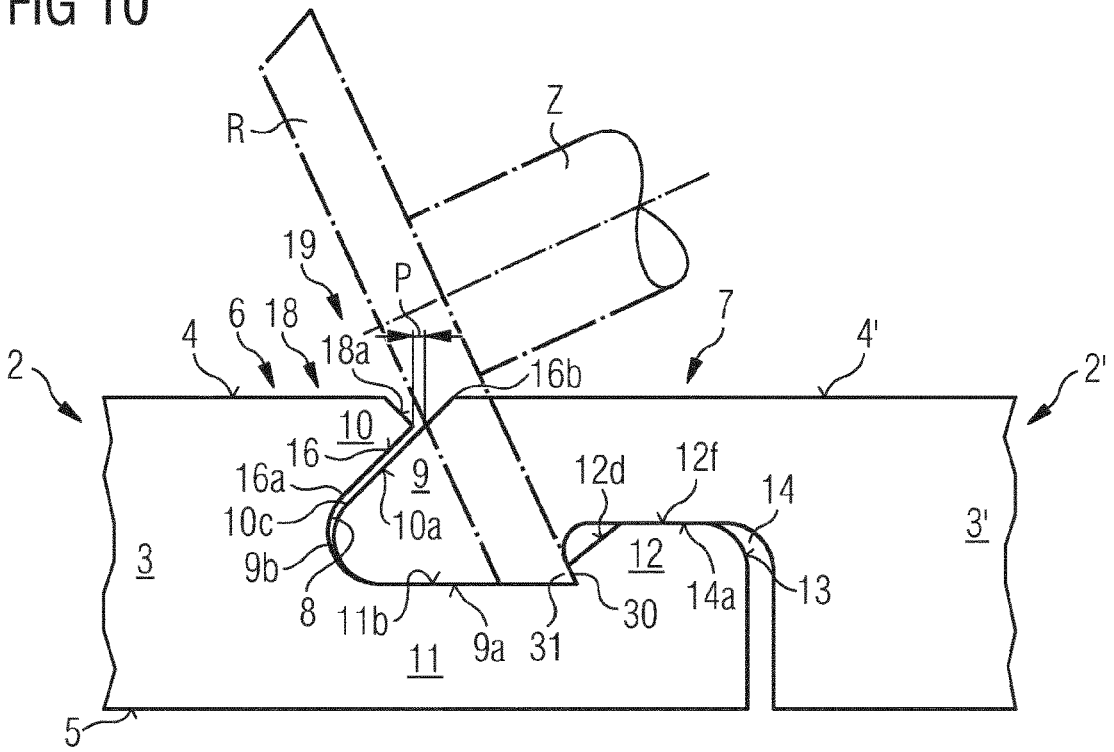
FIG. 10 shows a further embodiment of the panel.

FIG. 10 shows a panel which follows the principle of Figure group 8, that is to say it has a rearward positively locking action. That can be implemented by a notch 30 at the holding bar of the locking groove and a projection 31 of matching configuration at the locking tongue 9, which fits into the notch 30. If the maximum play P occurs at the panel surface in the inserted state then the projection 31 is moved into the notch to the maximum depth so that the rearward positively locking engagement then achieves its best locking action perpendicularly to the panel surface. In the joining operation the projection 31 can freely pass the proximal end of the free surface 12*d* and the tongue underside 9*a* can pass on to the contact surface lib of the lower groove wall. Elastic deformation which is required during the joining operation at the holding profiles is not involved in the case of the present embodiment.

In the FIG. 10 embodiment the notch is of a cross-section which is produced by means of a milling tool. A dash-dotted line in FIG. 10 denotes the milling tool R and its drive spindle Z about which the milling tool rotates.

In comparison with Figure group 8 the locking groove is of a greater radius at its groove bottom. The distal end 16*a* of the straight portion of the tongue top side 16 is at a somewhat higher level than the contact surface 12*f* of the holding bar 12 or the bar end 12*a*. It has the advantage that the risk of cracking or splitting can be somewhat reduced in the region of the enlarged radius which forms the bottom of the locking groove.

An enlarged radius at the groove bottom is advantageous not only for the present embodiment but is a desirable option for all previous embodiments.

If the distal end 16*a* of the straight portion of the tongue top side 16 lies over the bar end 12*a*, as in FIG. 10, then it should desirably lie in a region above the bar end, the size of which corresponds to the height T of the free surface.

If the projection 31 is moved to maximum depth into the notch 30 then that side of the notch which is closer to the panel surface is in positively locking contact with a top side of the projection. In that case some clearance can be provided between the free end of the projection and the bottom of the notch and thus a free space can be formed. The free space serves for reliably implementing the positively locking engagement and in addition any dirt particles can be received there.

Figure 11:
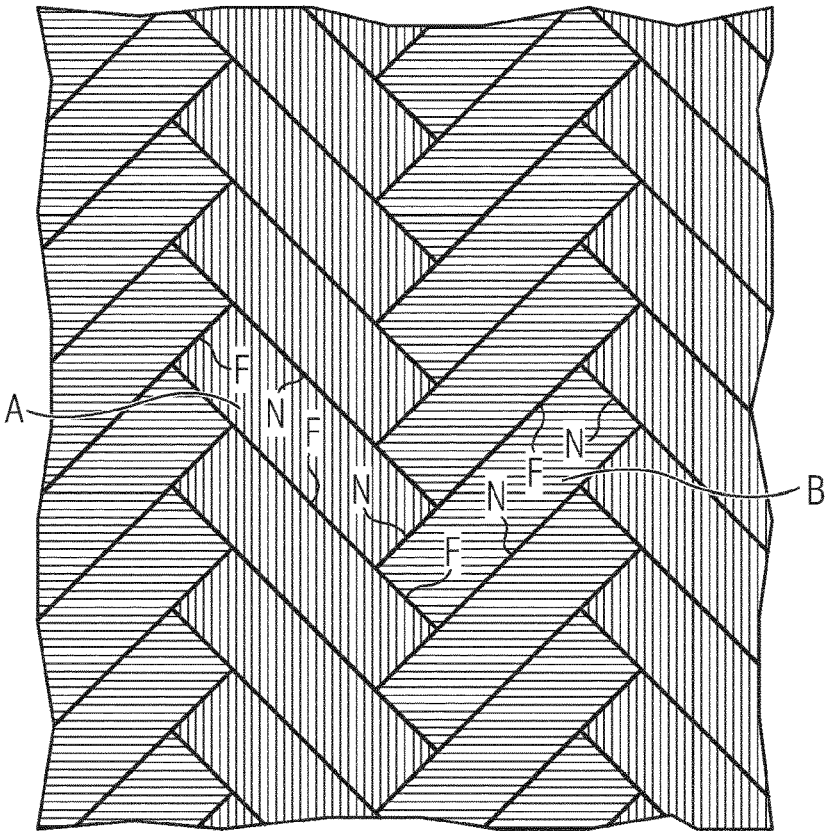
FIG. 11 shows a plan view of a herringbone laying pattern with the panel according to the invention.

FIG. 11 shows an application of the panel according to the invention for producing a covering using a herringbone laying pattern. For that purpose two different types of panel are required, a type A and a type B. The two panel types A and B have an edge pair of an identical configuration, that is to say the locking groove of type A is arranged on the same panel edge as in the case of panel type B and likewise the locking tongue of type A is arranged on the same panel edge as in the case of panel type B. However, the other edge pair is side-reversed in type B relative to type A, that is to say that panel edge which in type A is provided with the locking tongue has the locking groove in type B and vice-versa. In the present example both types have a pair of long panel edges and a pair of short panel edges. The long panel edges are of an identical configuration in type A as in type B. The short panel edges differ. At that panel edge at which type A has the locking tongue type B has the locking groove. Where type A has the locking groove type B in turn has the locking tongue.

In production of the panels type A and B the holding profiles of the long edges are firstly milled. Then the panels are further transported within the production installation to mill the short edges, in which case half of the panels of a batch have to be turned through 180° prior to the milling operation to produce the short edges on that part of the panels in side-reversed relationship. That laying pattern means that long panel edges and short panel edges can be locked together. Different edge pairs, for example a long edge and a short edge therefore have to be mutually compatible. In that way it is possible to produce a herringbone laying pattern. What is particular therein is that the panels are lockable in positively locking relationship on all sides, wherein a locking action is achieved in the panel plane (horizontally), more particularly perpendicularly to the locked edges but also a locking action in a direction perpendicular to the panel plane (vertically). In the case of a rectangular or square panel the horizontal and vertical locking effect is therefore possible at both edge pairs.

The herringbone laying pattern can then be implemented with the panel types A and B produced in that way. FIG. 11 diagrammatically shows a surface comprising locked panels arranged in the herringbone laying pattern. In that case for example a panel of type A and a panel of type B are distinguished from each other by different hatching. In that view F respectively indicates where, in each panel type, there is a tongue, while N respectively indicates where there is a groove.

By virtue of the advantageous handleability of the positively locking holding profiles of the panel according to the invention locking of the panels together is very simple even when two panel types are involved and they are assembled to form a floor covering in the illustrated herringbone pattern.

A ninth embodiment of the panel according to the invention is shown in FIGS. 12*a* to 12*f*. It is based on that shown in Figure group 1. The features common thereto are noted in Figure group 12 by identical references to Figure group 1. In comparison with Figure group 1 the ninth embodiment however has a curved free surface 12*d* at the holding bar 12. A curvature 36, here a radius, is also provided between the tongue underside 9*a* and the contact surface 15. The curvature 36 and the curved free surface 12*d* provides space to be easily able to insert the locking tongue 9 of the one panel edge 2' into the recess 11*a* in the lower groove wall 11 of the complementary panel edge 2. The lower groove wall 11 has a contact surface 11*b* parallel to the panel surface, wherein the contact surface 11*b* goes into a curvature 37 which rises towards the groove bottom. The curvature 37 is here also in the form of a radius. The curvature 37 increases the stability of the locking groove where the further groove wall 11 begins on the panel core 3. In addition an inclined surface 38 adjoins the tongue underside 9*a* in the direction towards the free end of the locking tongue. The inclined surface 38 is inclined oppositely to the tongue top side 16. The surface 38 forms a wedge shape with the tongue top side 16. The wedge shape converges in a point towards the free end of the locking tongue. The wedge tip is rounded with a radius 39 at the front end 9*b*.

The recess 14 is provided with a surface 40 curved in a concave configuration. The curvature of the surface 40 matches the radius 13 on the holding bar 12 and can bear snugly against same, as can be seen from FIG. 12*d*.

Figure 12A:
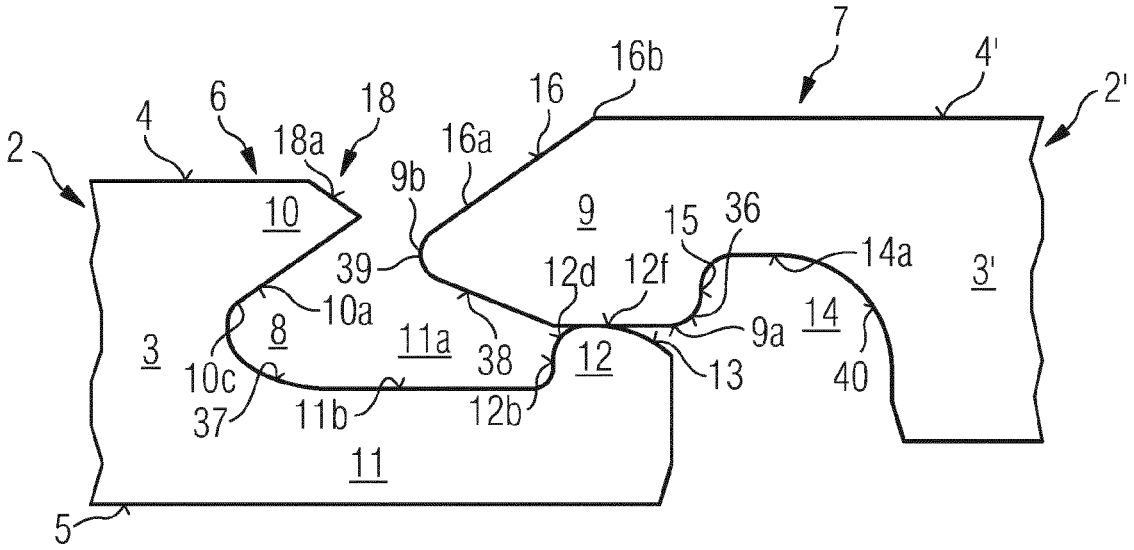
FIG. 12*a* shows a ninth embodiment of a panel according to the invention, with the panel being shown in an exploded view to illustrate its complementary holding profiles of an edge pair in the course of a joining movement.
Figure 12B:
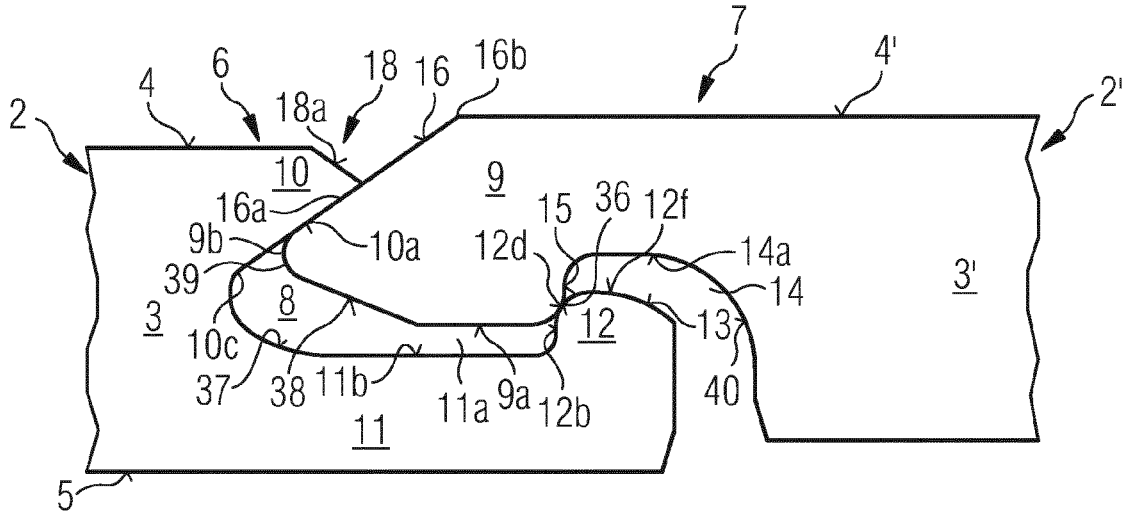
FIG. 12*b* shows the panel of FIG. 12*a* in an advanced stage in the joining movement.

Referring to FIG. 12*b* the panel edge 2' can be held with the locking tongue 9 parallel relative to the panel edge 2 so that parallelism prevails between the panel surfaces 4 and 4'. To lock the panel edges together the panel edges only have to be moved towards each other in the horizontal direction. The tongue underside 9*a* then drops down on to the contact surface 11*b* under the inherent weight of the panel.

In the locked state there is a certain play, more specifically both in the horizontal and also in the vertical direction. FIGS. 12*c*, 12*d*, 12*e* and 12*f* each show the locked state, but with the locked panel edges assuming different positions relative to each other.

Figure 12C:
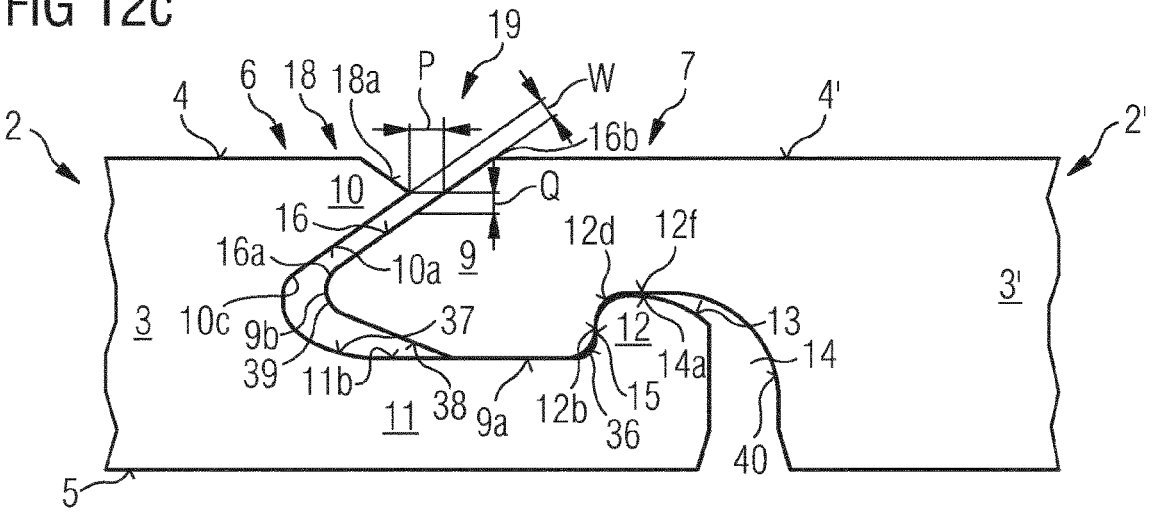
FIG. 12*c* shows the panel of FIG. 12 in the locked state with play and with maximum gap at the panel top side.

In FIG. 12*c* the panel top surfaces 4 and 4' are in the same horizontal plane. A maximum gap W is formed between the inside 10*a* of the upper groove wall and the tongue top side 16. The gap W is smaller than the dimension of the horizontal play P. The holding surface 12*b* of the holding bar 12 is in contact with the contact surface 15 of the locking tongue 9.

As shown in FIG. 12*c* the bottom surface 14*a* of the recess 14 rests on the contact surface 12*f* of the holding bar 12. The concave curvature 40 of the recess is spaced at a distance from the radius 13 of the holding bar 12.

Figure 12D:
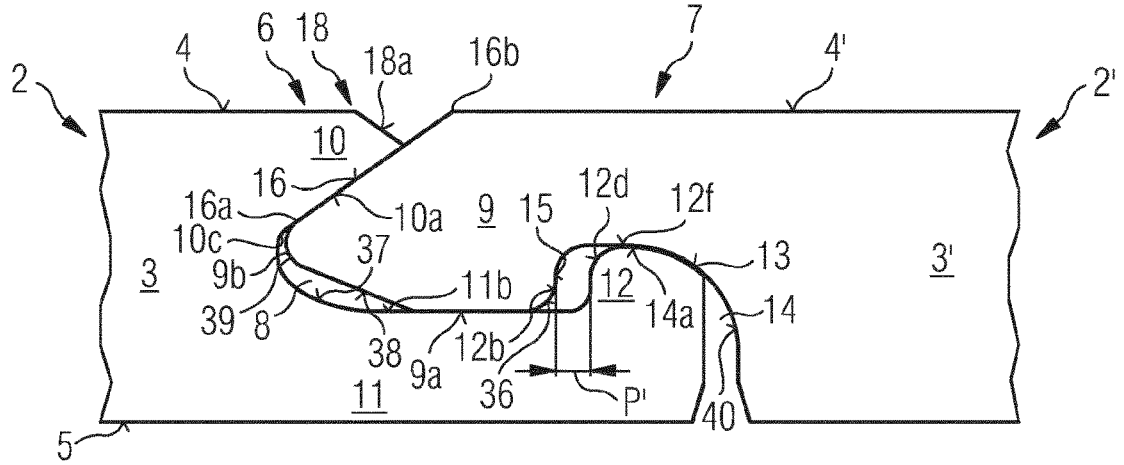
FIG. 12*d* shows the panel of FIG. 12 in the locked state with play and with closed gap at the panel top side.

In FIG. 12*d* the panel edges 2 and 2' in contrast are moved closer towards each other so that here the concave curvature 40 is in contact with the radius 13 of the holding bar 12. The gap W has disappeared so that the inside 10*a* of the upper groove wall is in contact with the tongue top side 16. Moreover the panel top surfaces 4 and 4' are in the same horizontal plane.

Figure 12E:
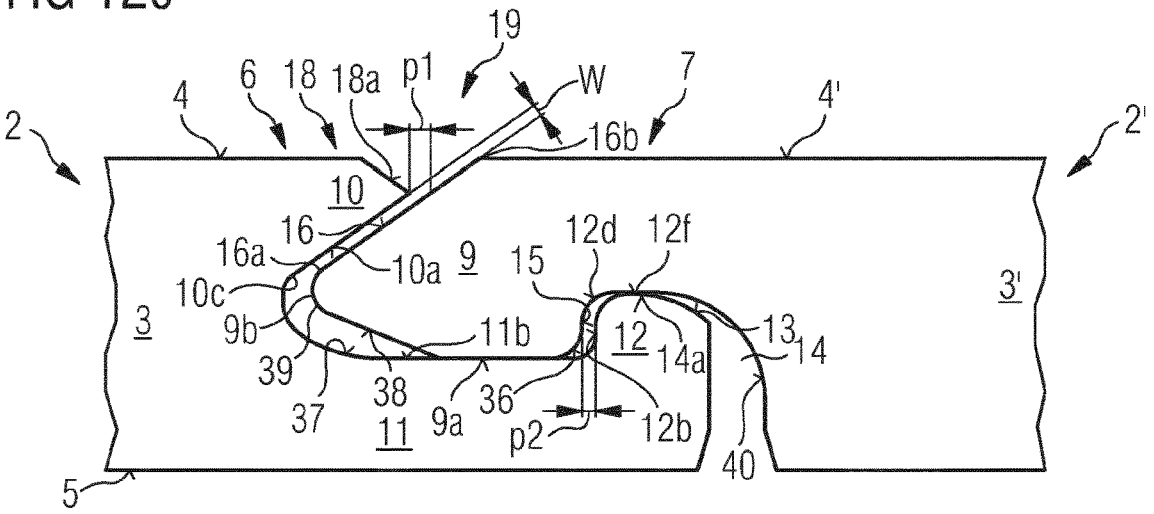
FIG. 12*e* shows the panel of FIG. 12*a* in the locked state in a central position within the limits of the existing play.

Following FIG. 12*e* shows an intermediate position with play at two locations. On the one hand once again there is a gap W (play) between the inside 10*a* of the upper groove wall and the tongue top side 16; the gap W however is smaller than in FIG. 12*c*. In addition there is a play P' between the holding surface 12*b* on the holding bar 12 and the contact surface 15 of the locking tongue 9.

Figure 12F:
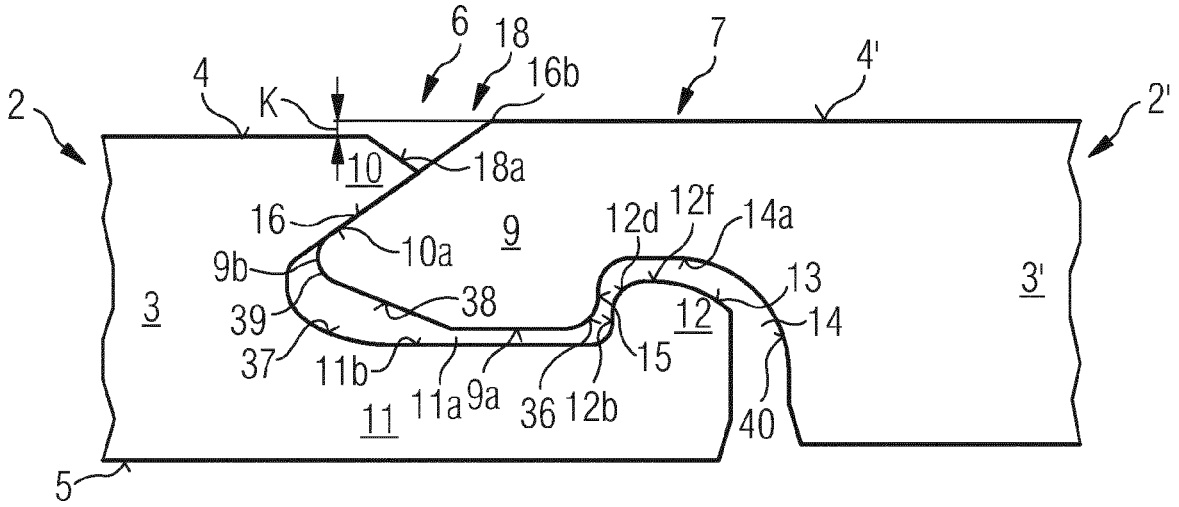
FIG. 12*f* shows the panel of FIG. 12*a* in the locked state with heightwise displacement.

FIG. 12*f* shows a locked state of the panel edges 2 and 2', in which the panel edge 2' with the locking tongue 9 involves a heightwise displacement relative to the panel edge 2 provided with the locking groove 8. The heightwise displacement is shown by the panel top surface 4 which is at a lower level than the panel top surface 4'. As a result the tongue underside 9*a* is no longer in contact with the contact surface 11*b*. The contact between the holding surface 12*b* and the contact surface 15 of the locking tongue 9 has become somewhat smaller but there is a sufficient remaining surface contact between the holding surface and the contact surface, that holds the panel edges together in positively locking contact and prevents them from being moved away from each other in the horizontal direction.

Figure 12G:
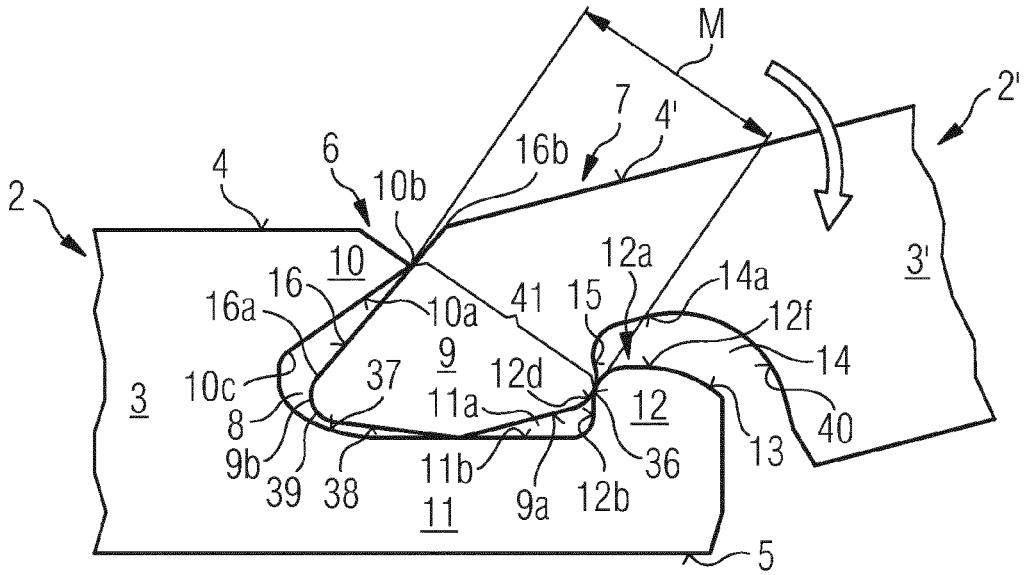
FIG. 12*g* shows a panel based on the example of FIG. 12*a* with a modification.

FIG. 12*g* shows an embodiment which differs from FIGS. 12*a* to 12*f*. Its geometry has been modified. By virtue of that modification the complementary panel edges cannot be locked by being pushed towards each other in a parallel orientation; they cannot be connected together in positively locking relationship by an only horizontal movement.

The locking groove has an opening 41 with a minimal opening dimension M. The locking tongue cannot fit through the opening because the extent of the locking tongue is too great for that as long as the two panels are oriented parallel to each other.

In this embodiment however the locking tongue is of a particular configuration. Its extent which has to pass through the opening is more specifically smaller when the panel provided with the locking tongue is lifted/angled through an angle γ. In the lifted/angled position the locking tongue 9 passes through the opening 41. No deformation or expansion of the opening is required for that.

By virtue of the proposed configuration it is advantageously possible for the panel edge 2' to be fitted inclinedly or angled through the certain angle γ relative to the complementary panel edge 2 in order in that way to lock it in positively locking relationship to that complementary panel edge.

Preferably, in the example shown in FIG. 12*g* that panel is inclinedly lifted/angled, that is provided with the locking tongue 9. The angled panel is then pivoted down into the plane of the lying panel in order to engage its locking tongue with the locking groove 8 in positively locking relationship.

The geometry of the panel edges shown in FIG. 12*g* differs from FIGS. 12*a* to 12*f* in particular by a higher holding bar 12. By virtue of the increase in height of the holding bar 12 the opening 41 of the locking groove has a smaller opening dimension than in the previous examples of FIGS. 12*a* to 12*f*, which accordingly can be locked in positively locking relationship by horizontal displacement of the panel edges towards each other (without lifting/angling).

The embodiment of FIG. 5*b* is designed in accordance with the same principle as FIG. 12*g*.

LIST OF REFERENCES

1 panel
2 panel edge
2' panel edge
3 panel core
3' panel core
4 panel surface
4' panel surface
5 lower panel surface
6 holding profile
7 holding profile
8 locking groove
9 locking tongue
9' tongue underside
9*b* front end
10 upper groove wall
10*a* inside
10*b* distal end
10*c* proximal end
11 lower groove wall
11*a* recess
11*b* contact surface
12 holding bar
12*a* bar end
12*b* holding surface
12*c* edge break
12*d* free surface
12*e* upper end
12*f* contact surface
13 radius
14 recess
14*a* bottom surface
15 contact surface
16 tongue top side
16*a* distal end
17 gap
18 edge break
18*a* bevel
19 V-shaped joint gap
20 convex curvature
21 concave curvature
22 convex curvature
23 second holding surface
24 second contact surface
25 concave curvature
26 convex curvature
27 recess
28 recess
29 run-on surface
29*a* distal end
30 notch
31 projection
32 new panel
32*a* locking tongue
32*b* locking tongue
32*c* locking groove
32*d* locking groove
33 panel
33*d* run-on surface
34 panel
34*d* run-on surface
35 panel
35*c* run-on surface
36 curvature
37 curvature
38 inclined surface
39 radius
40 concavely curved surface
41 opening
F tongue
M opening dimension
N groove
K heightwise displacement
L perpendicular
P play
P' play
$p_1$ play portion
$p_2$ play portion
Q vertical play
R milling tool
S height holding surface
T height free surface
U support surface
V arrow
W gap
Y hollow chamber
Z drive spindle
α angle of inclination
β angle of inclination
γ angle

The invention claimed is:

1. A panel comprising a panel core, a panel top surface, a lower panel surface and at least one first edge pair of complementary positively locking holding profiles at mutually opposite panel edges, wherein one of the holding profiles has a locking groove with a distally projecting upper groove wall and a lower groove wall that projects distally further than the upper groove wall, and comprising a holding bar that projects at a free end of the lower groove wall in a direction of the panel top surface and has a free upper bar end and at least one undercut holding surface, wherein said holding surface is directed towards the panel core and delimits in the lower groove wall a recess that is behind the holding bar, wherein the complementary holding profile is provided with a locking tongue that has at least one undercut contact surface that is directed towards the panel core and in an assembled state co-operates with the holding surface of the holding bar, wherein the locking tongue has a tongue underside and a tongue top side, the tongue top side having a distal end and a proximal end and is straight or curved and is arranged inclinedly relative to the perpendicular on the panel top surface so that the distal end is further away from the panel top surface and the proximal end reaches closer to the panel top surface, wherein in the assembled state there is a play that includes a vertical play and a horizontal play so that the holding profiles are movable perpendicularly to the panel top surface and are movable in a direction that is perpendicular to the panel edges and simultaneously parallel to the panel top surface, wherein an inside of the upper groove wall is of a straight or curved shape matching the tongue top side and relative to the perpendicular to the panel surface has an angle of inclination α so that the inclined tongue top side and the inside of the upper groove wall are in surface contact in the mutually displaced state, wherein an edge break is provided between the free upper bar end of the holding bar and a lower holding surface of the holding bar, wherein the edge break forms a free surface that has a distal upper end and a proximal end and is of a straight or curved shape, and wherein the free surface has an angle of inclination β relative to the perpendicular on the panel top surface so that in a joining step the tongue underside of the locking tongue is horizontally slidable on the holding bar of the locking groove until the tongue top side contacts the inside of the upper groove wall, and then the tongue top side is slidable against the inside of the upper groove wall and so that at the end of said joining step the distal end of the tongue top side contacts the inside of the upper groove wall in the region of the panel core.

2. The panel according to claim 1, wherein the locking tongue has an edge break between the tongue underside and the undercut contact surface, wherein the edge break, in relation to the edge break of the holding bar, has a cross-section that is at least 50% smaller.

3. The panel according to claim 1, wherein a height of the free surface is > the height of the holding surface of the holding bar.

4. The panel according to claim 1, wherein a distal end of the tongue top side in the assembled state is on a level between the upper free bar end of the holding bar and a proximal end of the free surface or is above the free bar end by an amount corresponding to the height of the free surface.

5. The panel according to claim 1, wherein the tongue underside has a sliding surface that is arranged parallel to the panel top surface and in the assembled state is supported on a sliding zone in the recess of the upper groove wall, the sliding zone being arranged in turn parallel to the panel top surface.

6. The panel according to claim 1, wherein the holding bar forms a contact surface that the tongue underside can be placed on at least during the joining operation and the locking tongue has a recess that is open towards the lower panel surface and has a bottom surface.

7. The panel according to claim 6, wherein the contact surface of the holding bar and the bottom surface of the recess are in mutually parallel and contacting relationship in the assembled state so that within the present play the contact surface and the bottom surface act as sliding surfaces parallel to the panel top surface.

8. The panel according to claim 1, wherein a maximum vertical play, when the undercut holding surface of the locking groove and the undercut contact surface of the locking tongue are in contact, is in a ratio Q/S relative to the height of the holding surface, that is in a range of 0.5-2.0.

9. The panel according to claim 8, wherein the ratio Q/S is in the range of 0.8-1.2.

10. The panel according to claim 1, wherein the angle of inclination α of the inside of the upper groove wall relative to the perpendicular on the panel top surface is in the range of 30° to 60°.

11. The panel according to claim 1, wherein the free surface of the holding bar is inclined through a free angle β relative to the perpendicular on the panel top surface and the free angle β≥angle of inclination β.

12. The panel according to claim 11, wherein the free angle β is in the range of 1.0 to 1.5 times the angle of inclination a.

13. The panel according to claim 12, wherein the second holding surface of the holding bar is arranged at a distal end of the free surface.

14. The panel according to claim 1, wherein provided on the holding bar is a second distal holding surface directed towards the panel core and the locking tongue in matching relationship therewith has a proximal second contact surface.

15. The panel according to claim 1, wherein the panel top surface has an edge break at least on the side of the locking groove or on the side of the locking tongue.

16. The panel according to claim 1, wherein the panel is quadrangular and has a second edge pair which is provided at mutually opposite panel edges with complementary holding profiles, said holding profiles being identical to the holding profiles of the first edge pair.

17. A method of laying and locking panels according to claim 1, wherein the tongue underside of a new panel is laid on the holding bar of a panel that is already lying on a support surface so that the new panel is displaced lying in the panel plane perpendicularly to the panel edge against the lying panel until the tongue underside of the new panel has moved beyond the holding bar of the lying panel and moves downwardly into the recess behind the holding bar.

18. The method of laying and locking panels according to claim 17, wherein a new quadrangular panel of said type having two identical edge pairs is locked in a second panel row with panels of an existing first panel row and at the same time locked to a panel already present in the second row by the new panel being placed with a tongue underside of a locking tongue on the holding bars of the panels of the first panel row and with the tongue underside of the adjacent locking tongue on the holding bar of the panel already present in the second row, then the new panel is displaced in a diagonal direction whereby the two adjacent locking tongues are simultaneously brought into engagement, namely the locking tongue with the locking groove of the panels in the first panel row and the other locking tongue with the locking groove of the panel already present in the second row, wherein the tongue undersides of the two adjacent locking tongues of the new panel have moved beyond the holding bars of the laid panel and move downwardly into the respective recess behind the holding bar.

19. The panel according to claim 1, wherein the locking groove has a minimal opening between the distal end and the free surface, wherein the locking tongue does not pass through said minimal opening in a position where a tongue top side bears in surface contact against the inside of the upper groove wall and wherein simultaneously the locking tongue is of such a configuration that it is of a smaller configuration passing through the opening, and passes through the minimal opening of the locking groove only when that panel is angled through an angle γ to the locking tongue.

20. The panel according to claim 19, wherein the free surface is in the form of a radius.

21. The panel according to claim 19, wherein there is provided a horizontal contact surface in the recess of the lower groove wall and the contact surface goes into a curvature which rises towards the groove bottom.

22. The panel according to claim 21, wherein the curvature is in the form of a radius.

23. The panel according to claim 19, wherein a contact surface on the holding bar passes into a radius, a bottom surface of the recess goes into a recess and when in the assembled state the tongue top side contacts the inside of the upper groove wall at the same time the radius bears in surface contact against the radius.

* * * * *